United States Patent [19]

Campbell et al.

[11] 4,106,641

[45] Aug. 15, 1978

[54] UNIVERSAL GANTRY CRANE

[75] Inventors: George Thomas Richardson Campbell; Toshishige Kasuga; Kosaku Ohno, all of Tokyo, Japan

[73] Assignee: Algoship International Limited, Nassau, The Bahamas

[21] Appl. No.: 755,996

[22] Filed: Jan. 3, 1977

[30] Foreign Application Priority Data

| | | | |
|---|---|---|---|
| Mar. 17, 1976 | [JP] | Japan | 51-028921 |
| Apr. 9, 1976 | [JP] | Japan | 51-043834 |
| Jun. 24, 1976 | [JP] | Japan | 51-074742 |
| Aug. 24, 1976 | [JP] | Japan | 51-100793 |

[51] Int. Cl.[2] ..... B63B 27/12

[52] U.S. Cl. ..... 214/15 R; 212/15

[58] Field of Search ..... 214/14, 15 R; 212/10, 212/11, 12, 13, 14, 15, 16, 3

[56] References Cited

U.S. PATENT DOCUMENTS

| | | | |
|---|---|---|---|
| 2,456,104 | 12/1948 | Andersen | 214/15 R |
| 2,541,893 | 2/1951 | Speer | 214/15 R |
| 3,254,775 | 6/1966 | Bevard et al. | 214/15 R X |
| 3,317,058 | 5/1967 | Kummerman | 214/15 R X |
| 3,358,854 | 12/1967 | Montgomery, Jr. | 214/15 R |
| 3,380,422 | 4/1968 | Bachko | 214/15 R X |
| 3,598,256 | 8/1971 | Kinkopf | 214/15 R |

FOREIGN PATENT DOCUMENTS

| | | | |
|---|---|---|---|
| 2,201,343 | 8/1973 | Fed. Rep. of Germany | 212/13 |
| 182,305 | 7/1966 | U.S.S.R. | 212/14 |

*Primary Examiner*—Frank E. Werner

*Attorney, Agent, or Firm*—Larson, Taylor and Hinds

[57] ABSTRACT

A travelling gantry crane is mounted for movement along rails laid on the weather deck of a ship, but is adaptable for shore installations. Preferably two similar cranes are used in face-to-face arrangement and operable together as a unit for maximum lifting capacity, but they can be operated individually. Each travelling gantry crane has a pair of C-shaped leg members supporting between them a bridge girder, the leg members being movable by driven wheels. A shuttle girder is mounted for movement along the outward facing side of the bridge girder to provide for maximum outreach beyond the ends of the bridge girder. A load carrying trolley moves along the outward facing side of the shuttle girder remote from the bridge girder. The invention includes various detailed arrangements for moving the shuttle girder and the trolley, for securing the gantry crane on the rails, etc.

18 Claims, 31 Drawing Figures

UNIVERSAL GANTRY CRANE

This invention relates to travelling gantry cranes and particularly to gantry cranes having a shuttle girder movable along one vertical side of the bridge girder of the crane for outreaching the ends of the bridge girder and including a hoisting trolley movable along the shuttle girder.

In general, gantry cranes having a bridge girder are provided with a hoisting trolley movable along the length of the bridge girder. The limit of travel of the hoisting trolley thus limits the operational area of the crane to the area over which the gantry crane travels.

It has been known to provide extensions to the bridge girder of gantry cranes in order to increase their operational area outwardly of either end of the gantry. In U.S. Pat. No. 3,042,227 cantilever arms are pivotally mounted on a horizontal axis on the outer ends of the bridge girder, with the cantilever arms being folded down to lie against the legs of the gantry crane when the crane is not required to handle loads outwardly of the crane. It has also been known to mount cantilever arms on a vertical axis on the ends of the bridge girder, with the cantilever arms being folded inwardly to lie flat against the sides of the bridge girder. In each of these arrangements, the pivotal mounting of the cantilever arms must be of exceptional strength in order to support the cantilever arms when in their extended position, plus supporting the load of the hoisting trolley and the load carried by the hoisting trolley. In addition, when using such cantilever arms, it has been difficult to reave the ropes required for the operation of the hoisting trolley when the trolley is moved outwards onto the cantilever arms and to stow the ropes when the cantilever arms are folded back against the crane. It has also been known to mount a shuttle girder on the bridge girder of a gantry crane for movement outreaching the ends of the bridge girder. One such adaptation is shown in U.S. Pat. No. 3,358,854, issued Dec. 19, 1967. In the arrangement disclosed in this patent, the movement of the shuttle girder and the trolley are controlled by a single drive means whereby the trolley moves outwards on the shuttle girder only as the shuttle girder moves outwards. No load hoisting or lowering means are shown and if used, must form a part of the trolley.

The present invention is an improvement on our earlier travelling gantry crane disclosed in Canadian Patent No. 778,239, issued Feb. 13, 1968.

In the present invention there is provided a travelling gantry crane mounted for movement along rails laid on the weather deck of a ship, but which is equally adapted for shore installations. In order to provide for maximum operating capacity, preferably two similar cranes are used in face-to-face arrangement and operated together as a unit for maximum lifting capacity over any one hold of the ship, or they can be operated individually over separate holds of the ship.

The invention in one form consists essentially of a travelling gantry crane having a pair of C-shaped leg members supporting between them a bridge girder. The C-shaped leg members each include a base member provided at each end with a wheel assembly in which the wheel is driven by a hydraulic motor or equivalent power unit and is provided with a brake making braking contact with the rail below, a column member extends upwardly from one end of each of the base members, the upper portion of the column members extend upwardly and outwardly over the base members, and a bridge girder is supported on the upper ends of the column members so as to lie in a vertical plane intermediate of the length of the base members. A shuttle girder is mounted for movement along the outward facing side of the bridge girder to provide for maximum outreach beyond the ends of the bridge grider. A load carrying trolley is mounted for movement along the outward facing side of the shuttle girder remote from the bridge girder. In one instance, the bridge girder is formed by a pair of girders in spaced apart relationship and the shuttle girder and the load carrying trolley are suspended between the pair of girders for movement therealong. The traversing movement of the shuttle girder with respect to the bridge girder is, in one instance, carried out by means of a winch through a rope and sheave arrangement, while in another instance, the traversing movement of the shuttle girder is synchronized with the movement of the load carrying trolley with respect to the shuttle girder through a rope and sheave arrangement combined with a rope anchoring device which is movable from one fixed position on one end of a beam to another fixed position at the opposite end of the beam for maximum outreach of the shuttle girder from the gantry. A load hoisting and lowering arrangement includes a winch operated drum mounted on one leg of the gantry crane or the bridge girder and thence over sheaves on the trolley and load carrying hook block and thence back to the winch operated drum.

When the gantry cranes are not in use and particularly when the ship is at sea, the forward gantry crane is secured to the deck of the ship by means which will counteract the stresses in the crane and ship induced by rolling and pitching of the ship. The location of the securing means for the forward gantry crane is determined by the overall trim characters of the ship. The after gantry crane is preferably secured to the after superstructure.

The bridge girder, the shuttle girder and the load carrying trolley are in face-to-face assembly in the inner and upper portion of the C-shaped leg members of the gantry. With this arrangement, a pair of gantry cranes can be located facing each other and a maximum load can be supported and traversed within the enclosed area of the facing C-forms of the gantry legs.

A primary object of the invention is to provide a travelling gantry crane which includes a shuttle girder and a load carrying trolley mounted for movement along the shuttle girder in which the shuttle girder and the load carrying trolley operate in side-by-side arrangement with each other and with the bridge girder in order to provide minimum interference with the movement of each, and maximum outreach of the shuttle girder and load carrying trolley with respect to the bridge girder of the gantry.

A further object of the invention is to provide a gantry crane provided with a shuttle girder and a load hoisting trolley movable along the shuttle girder in which the load hoisting trolley travels a distance twice as long as the travel distance of the shuttle girder.

A further object of the invention is to provide a gantry structure having support legs of C-shape whereby the load to be transported by the crane moves within the C-shape of the legs.

A still further object of the invention is to provide a gantry crane arrangement in which a pair of gantry cranes having support legs of C-shape are operated together on a common rail structure in face-to-face arrangement to support a single load of maximum weight between them.

A further object of the invention is to provide a gantry crane in which the movement of the shuttle girder and the movement of the load carrying trolley are carried out with the use of a single winch and rope operated system.

A further object of the invention is to provide a gantry crane principally for use on board a ship in which provision is made to minimize the effects of rolling of the ship on the gantry crane while the ship is at sea.

A further object of the invention is to provide means whereby a gantry crane is securely located on the rails on which the crane is mounted to counteract against the outreaching of the crane shuttle girder and the load hoisting trolley on the shuttle girder, and to counteract against rolling of the ship while at sea.

These and other objects of the invention will be apparent from the following detailed description and the accompanying drawings in which.

Figure 4A:
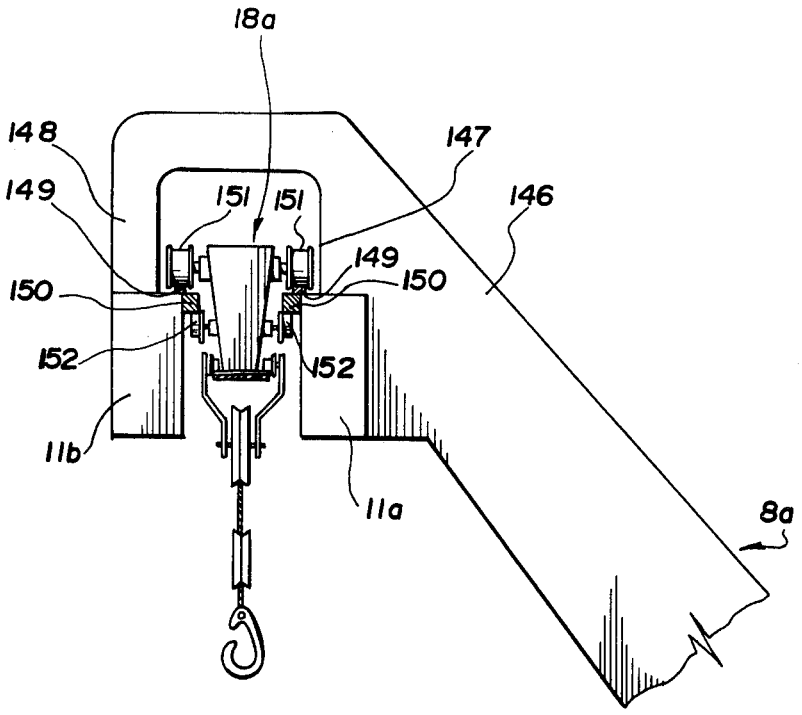

FIG. 4*a* is an outline of a modified form of the legs of the gantry crane, showing a pair of bridge girders supported by the legs of the crane and supporting between them a load carrying trolley.

Figure 3:
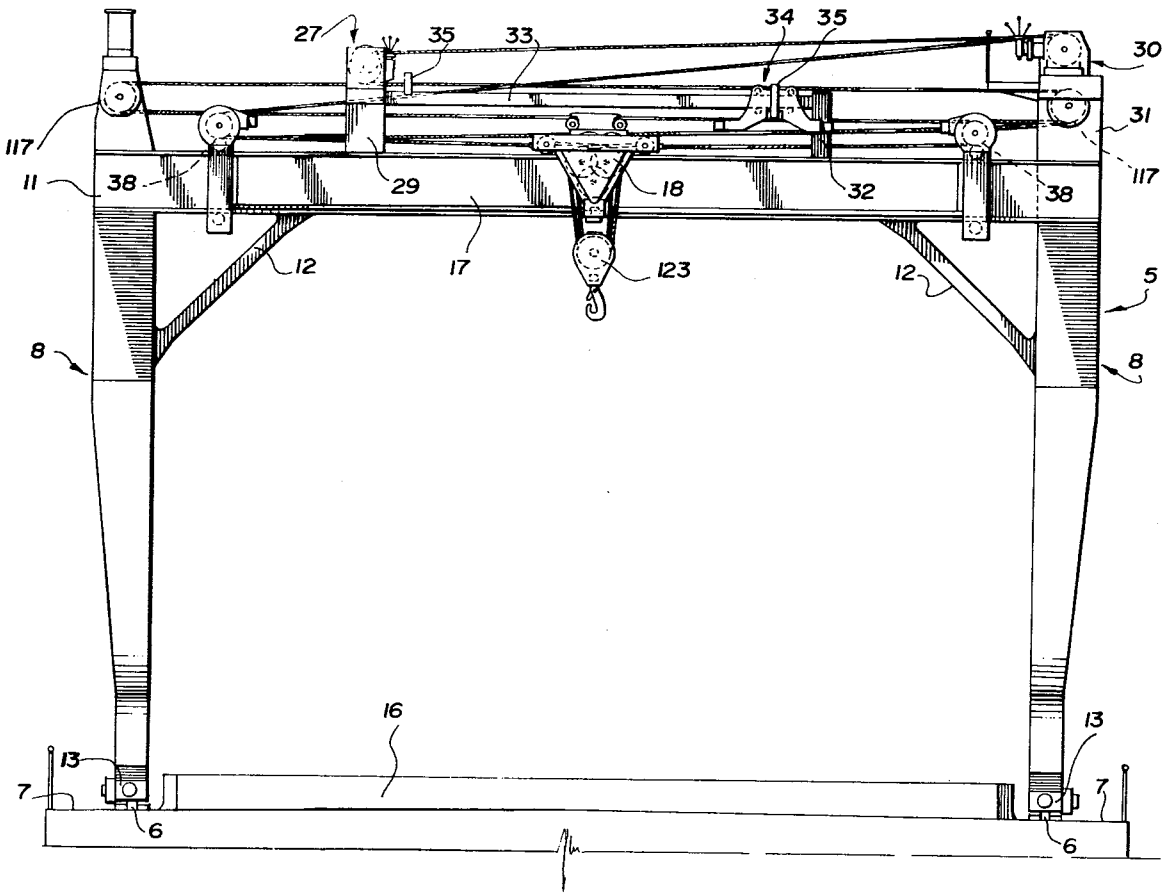
FIG. 3 is a front elevation of one of the gantry cranes with the shuttle girder and load carrying trolley in mid position on the bridge girder of the gantry crane.
Figure 5:
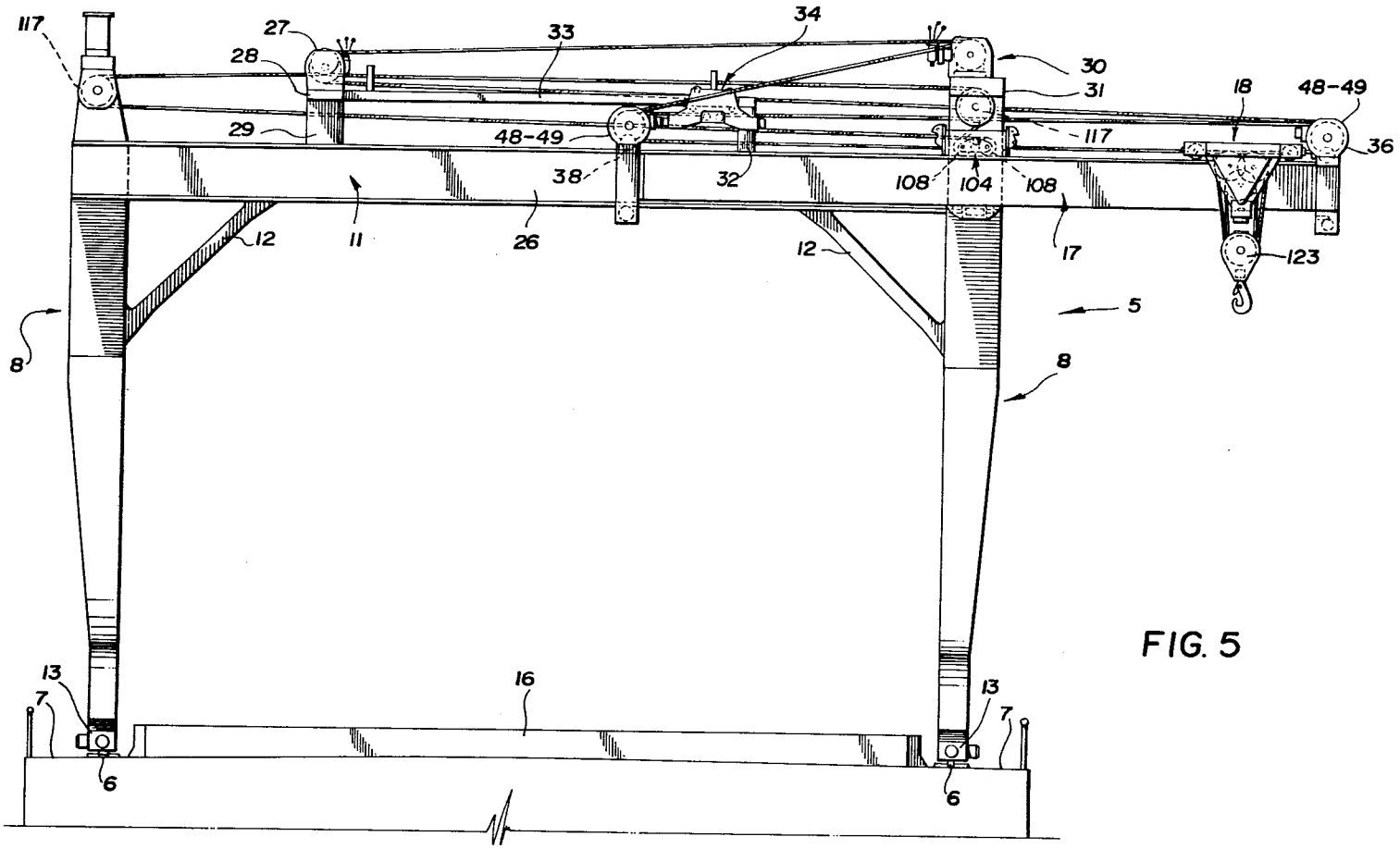

FIG. 5 is a view similar to FIG. 3, but showing the shuttle girder at maximum extension to one side of the gantry crane.

Figure 6:
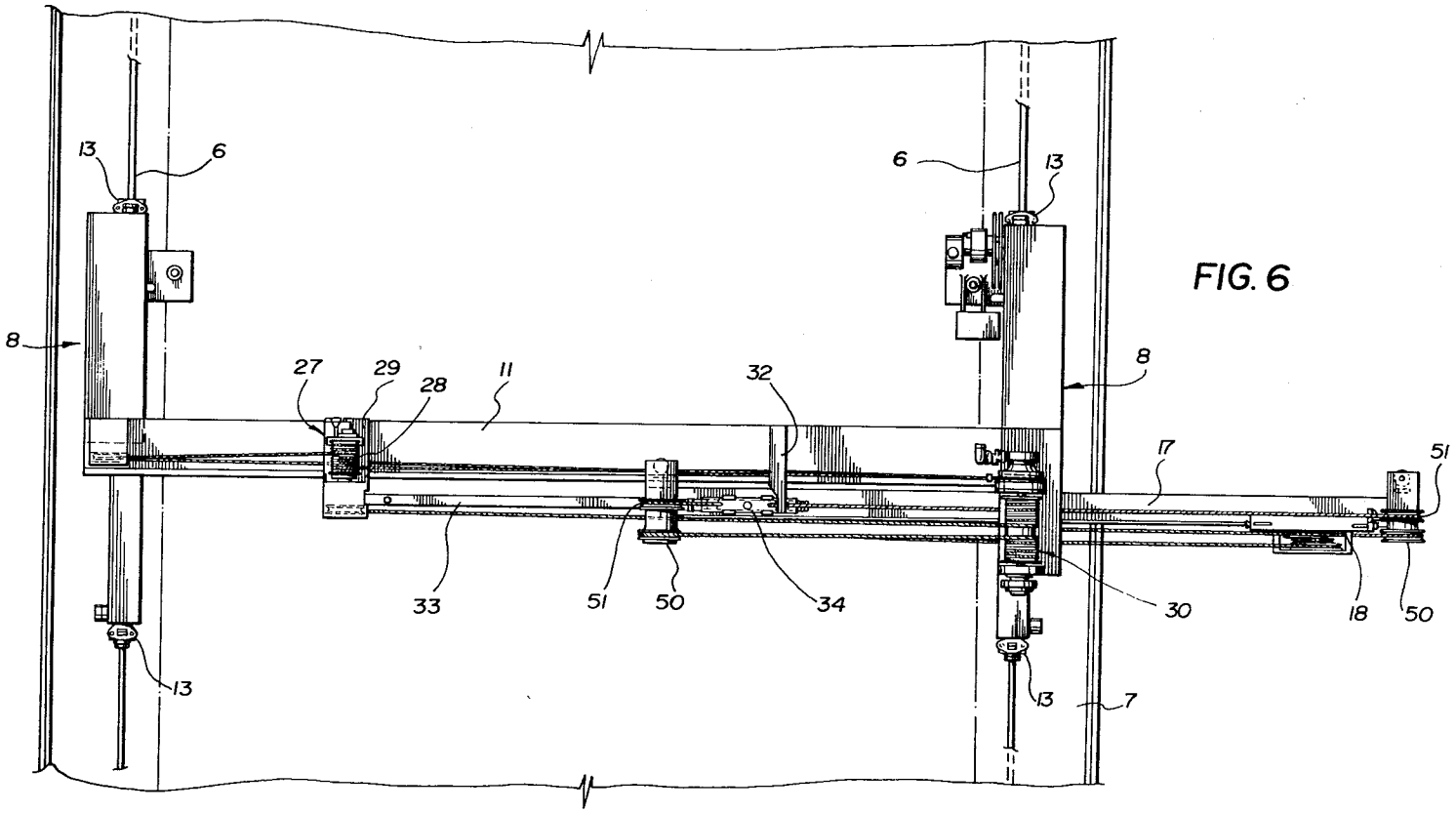

FIG. 6 is a plan view of the gantry crane shown in FIG. 5.

Figure 7:
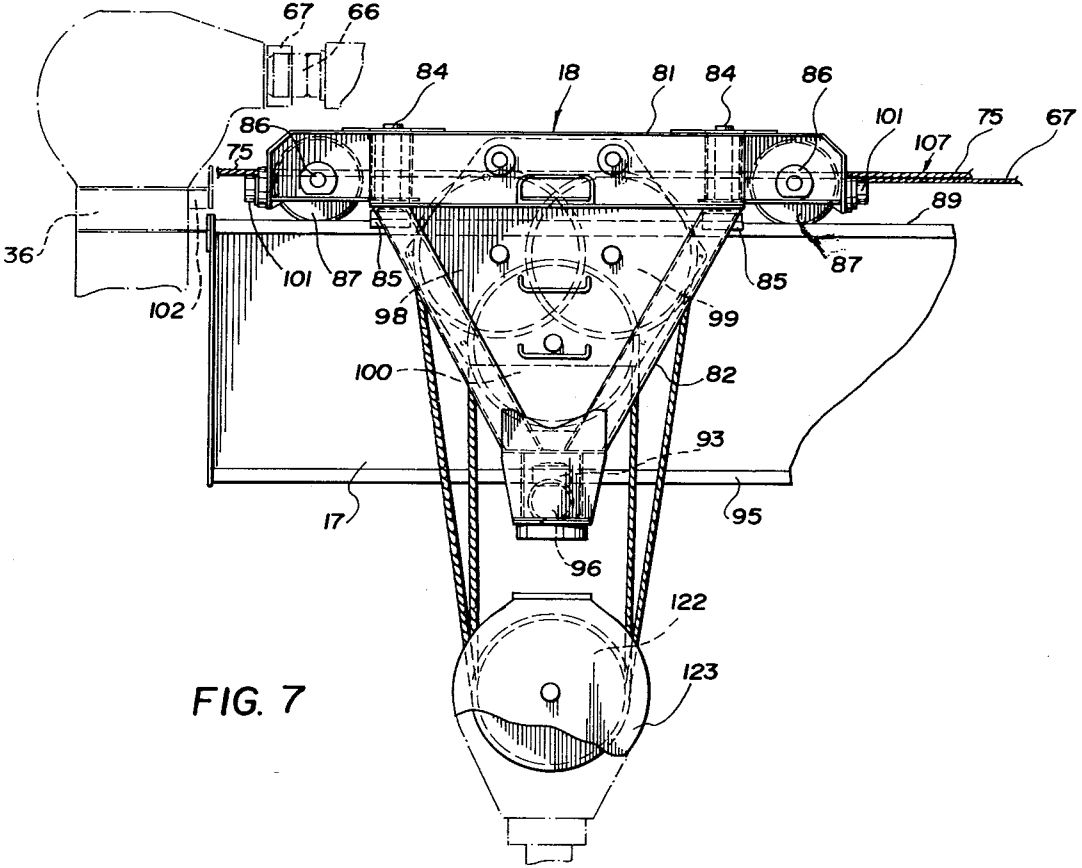

FIG. 7 is a side elevation of the trolley of the gantry crane.

Figure 8:
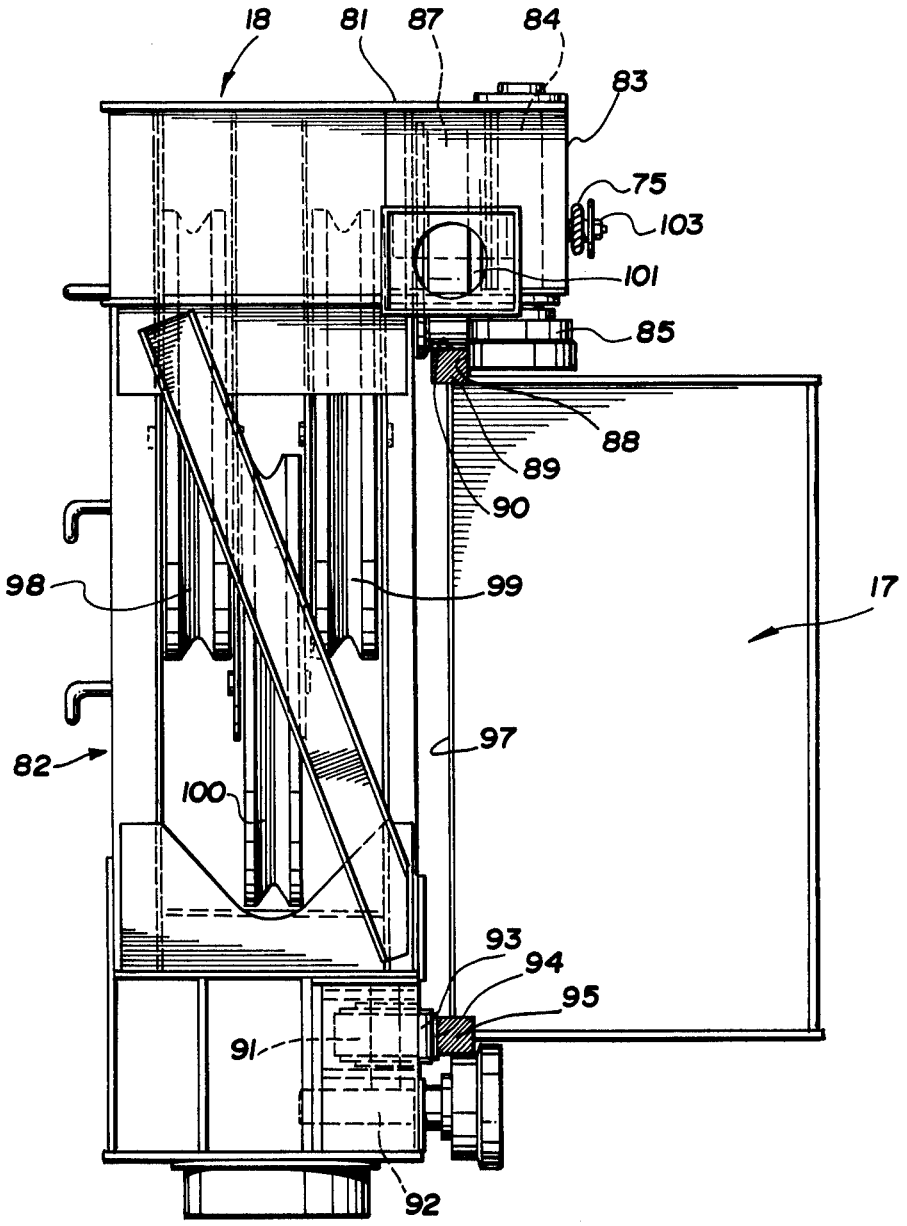

FIG. 8 is a side elevation of the trolley shown in FIG. 7.

Figure 9:
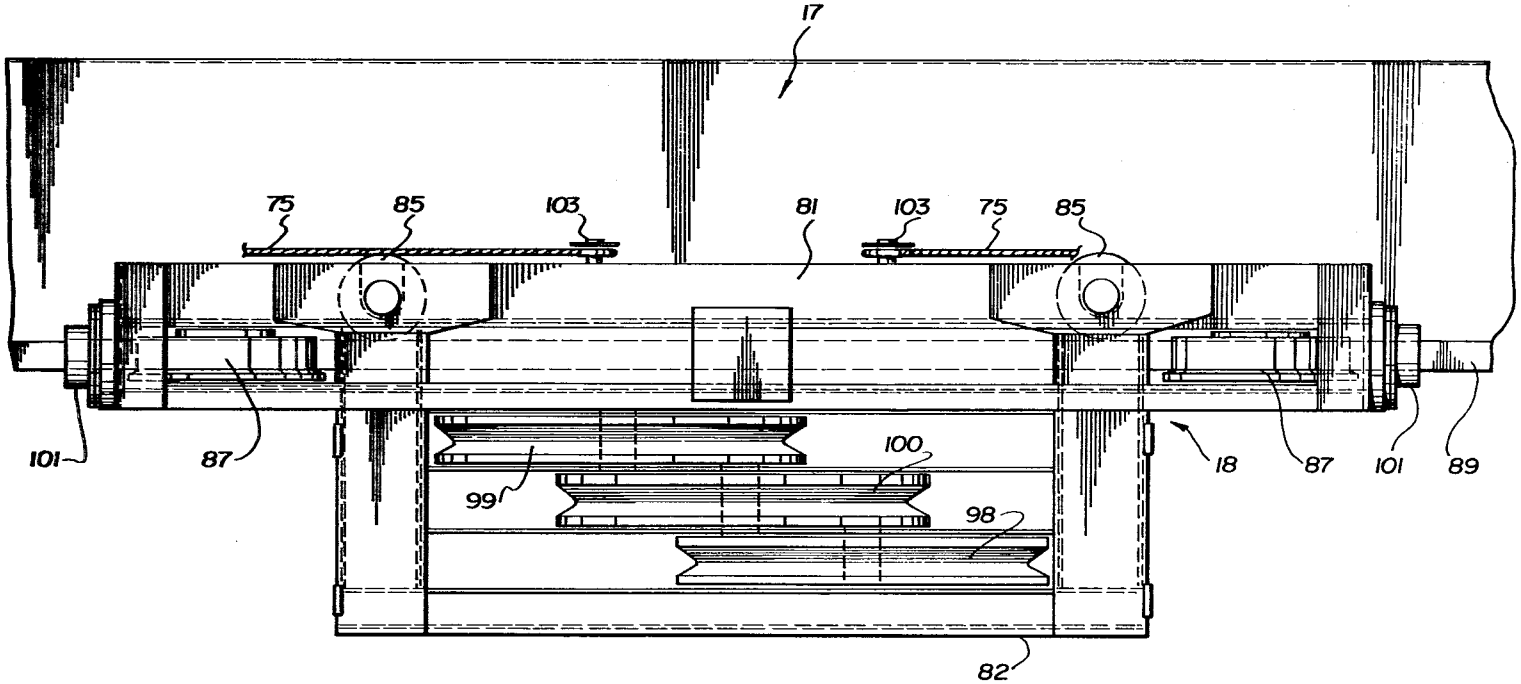

FIG. 9 is a top plan view of the trolley shown in FIGS. 7 and 8.

Figure 10:
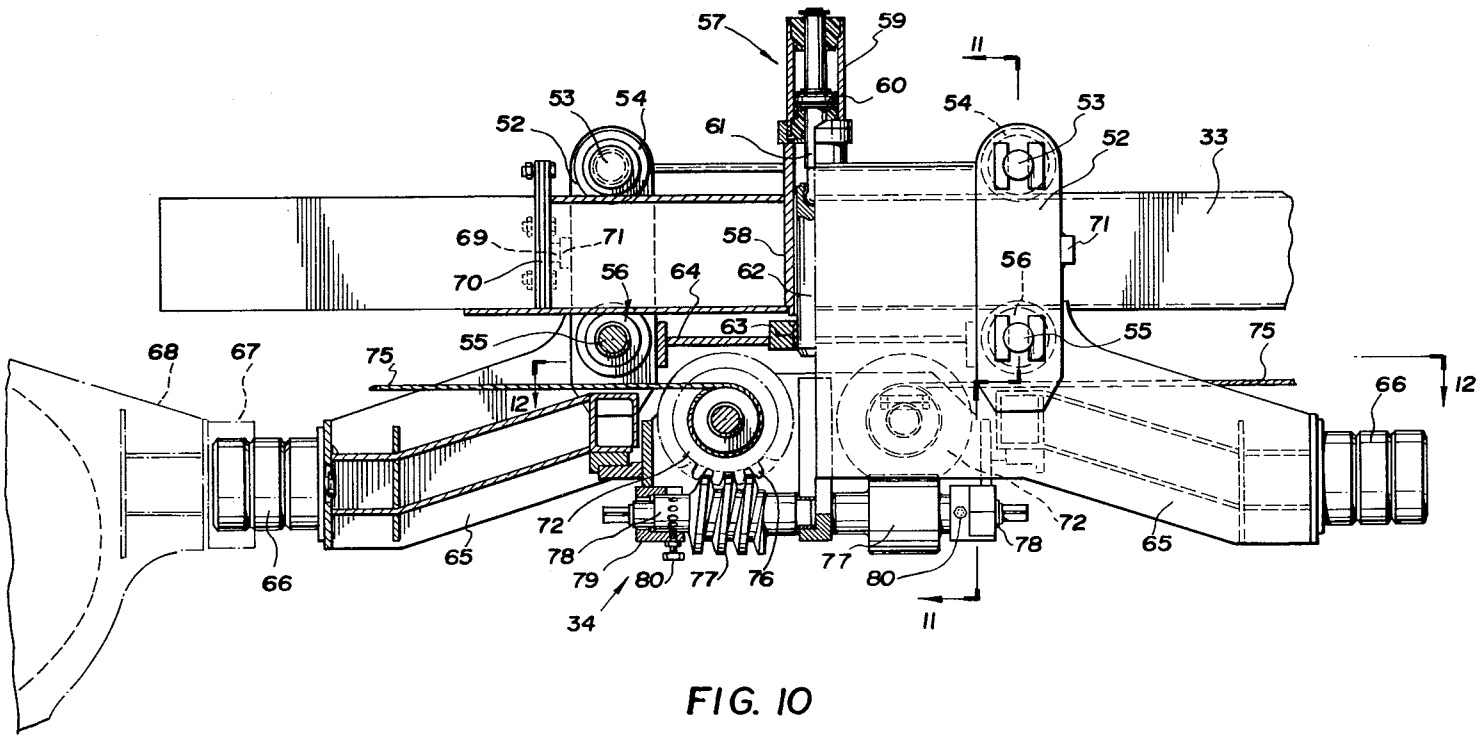

FIG. 10 is a side elevation partly in section of the trolley rope anchoring device mounted on a guide bar and showing the locking means between the rope anchoring device and the guide bar.

Figure 11:
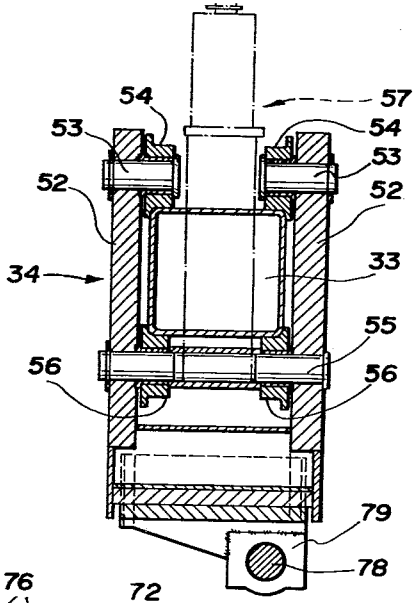

FIG. 11 is a vertical section taken on the line 11—11 of FIG. 10.

Figure 12:
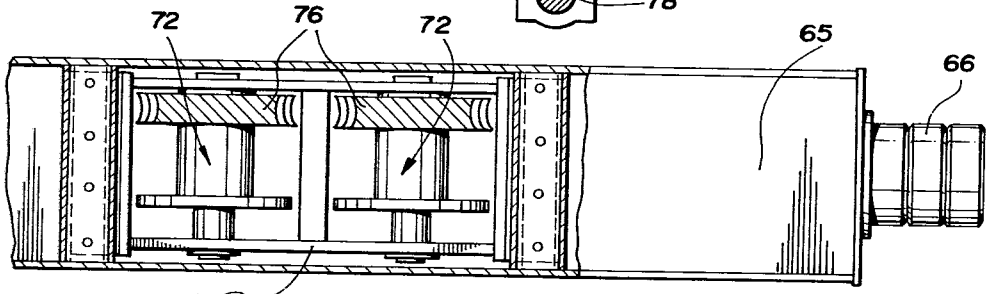

FIG. 12 is a bottom plan view of FIG. 10.

Figure 13:
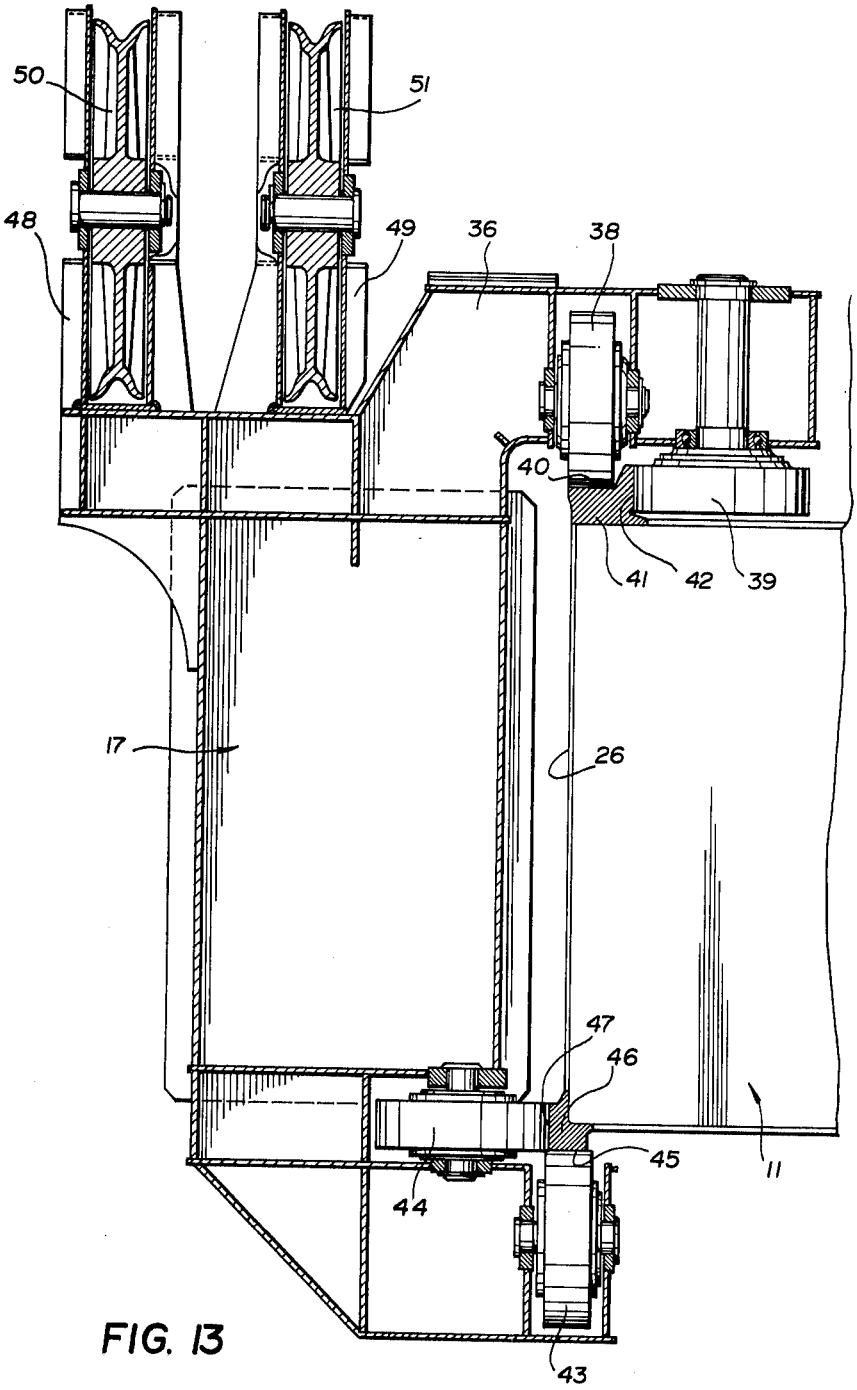

FIG. 13 is an enlarged sectional detail of the shuttle girder mounted on the bridge girder of the gantry crane.

Figure 14:
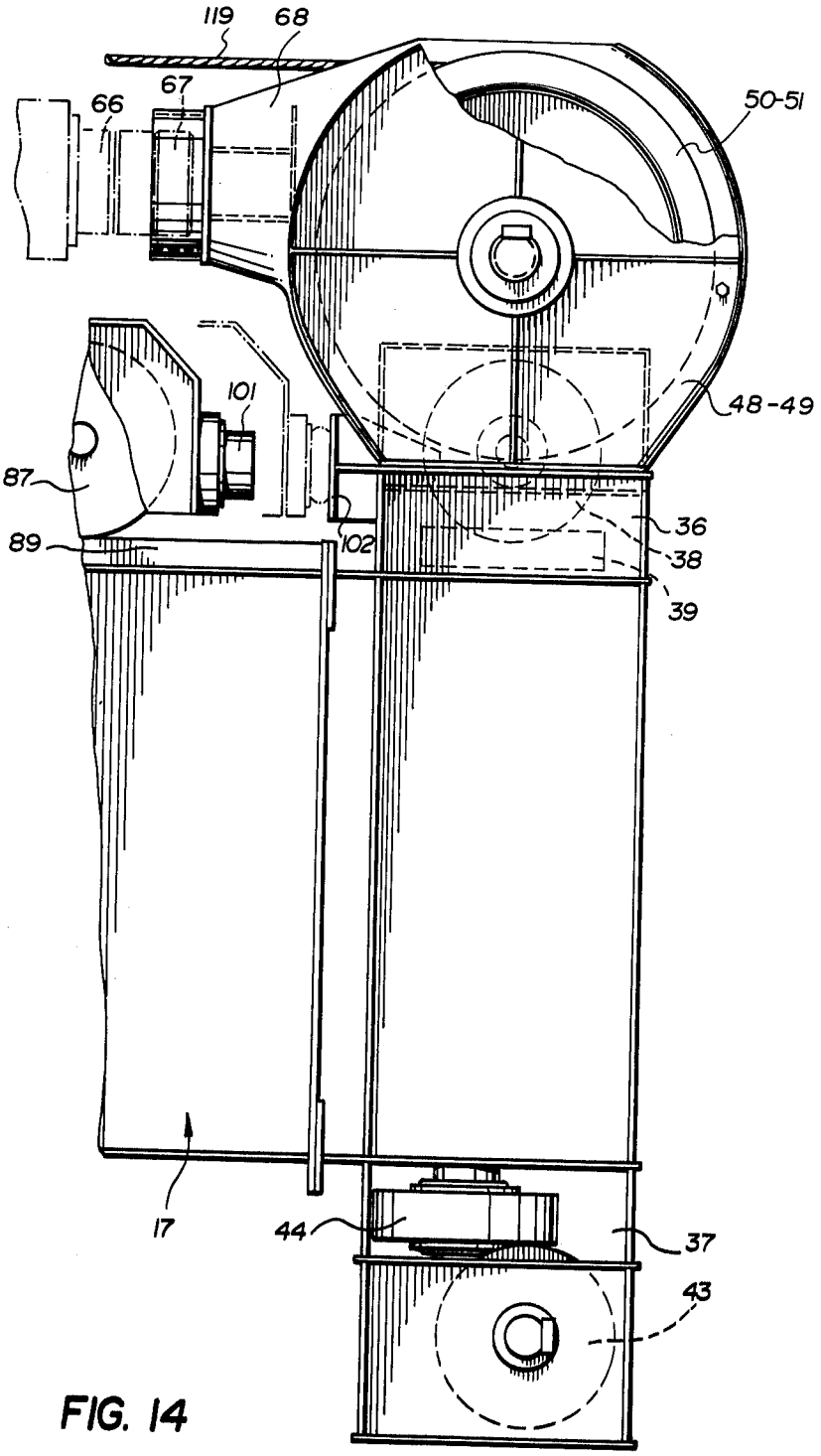

FIG. 14 is a side elevation of the one end of the shuttle girder, showing in outline one end of the trolley of FIGS. 7, 8 and 9 at the limit of its travel on the shuttle girder, and also showing the buffer contact between the shuttle girder and the trolley rope anchoring device of FIGS. 10, 11 and 12.

Figure 15:
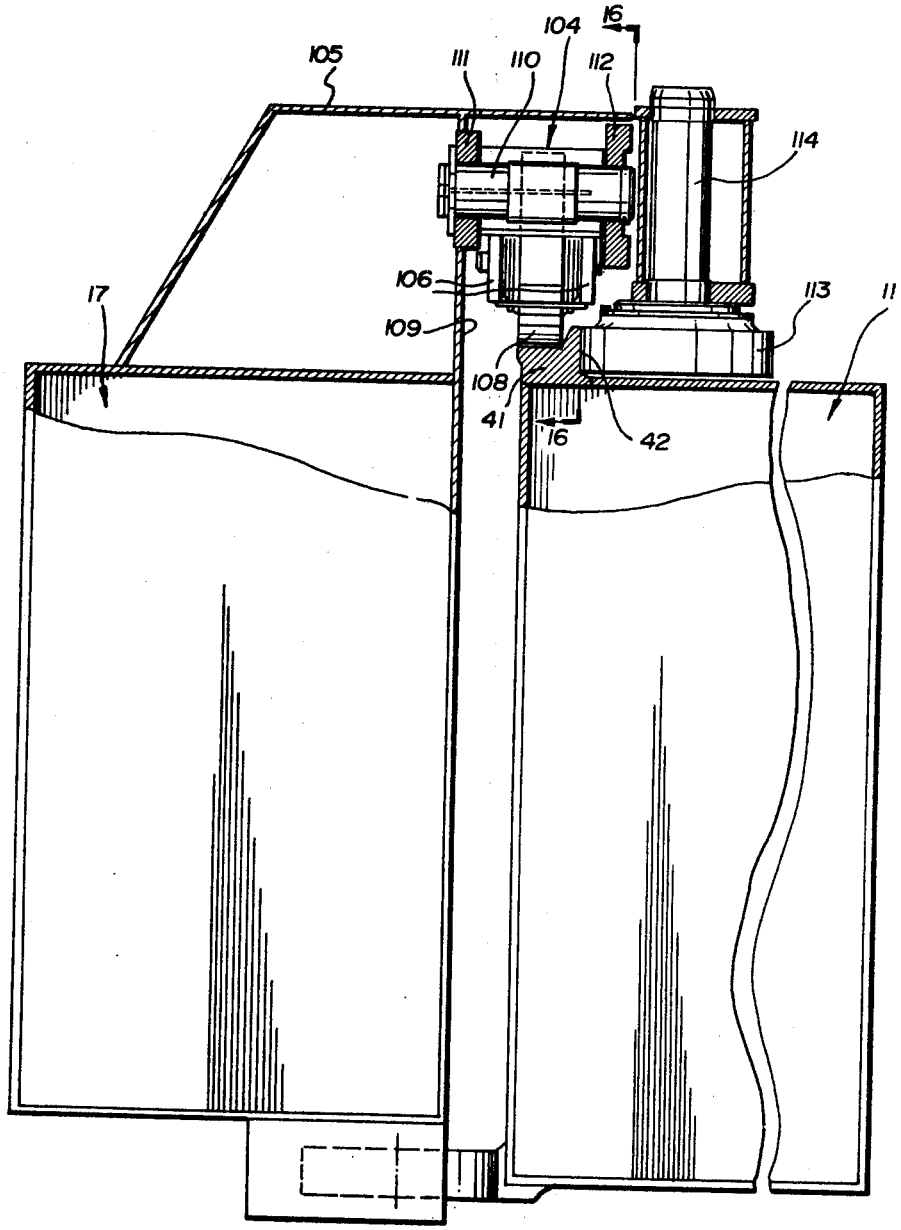

FIG. 15 is a vertical section of the bridge girder and shuttle girder showing the pivotal mounting of the rocker unit on the shuttle girder.

Figure 16:
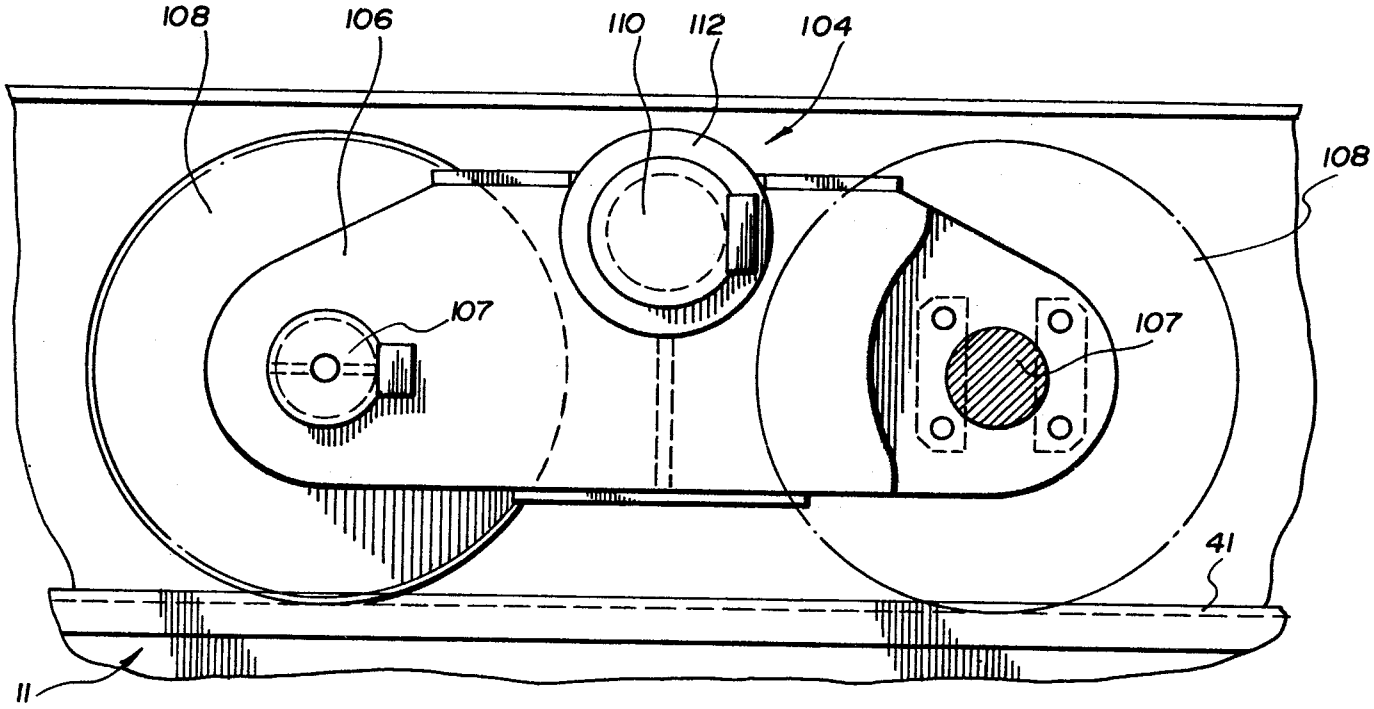

FIG. 16 is an enlarged side view of a rocker unit mounted on a bracket midway of the length of the shuttle girder, taken on the line 16—16 of FIG. 15.

Figure 17:
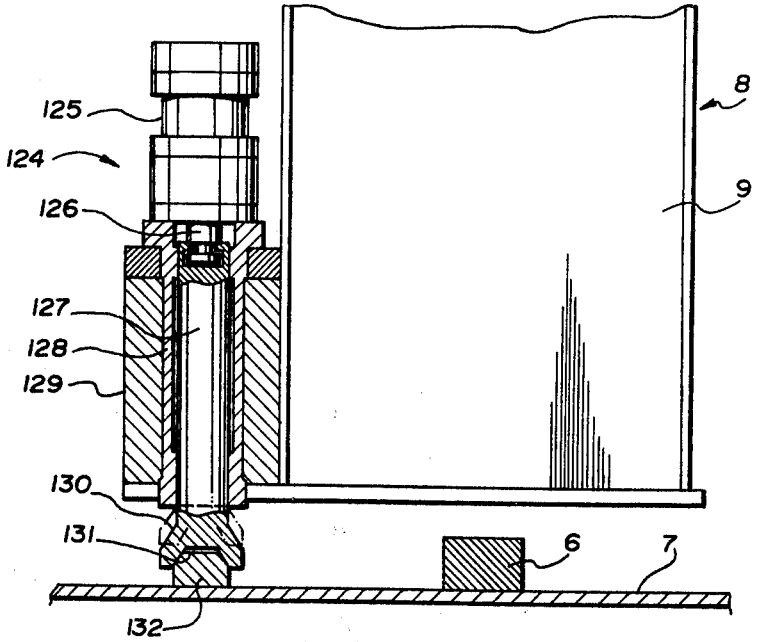

FIG. 17 is a vertical section of the base member of the gantry leg showing the means for locking the gantry to selected positions on the deck.

Figure 18:
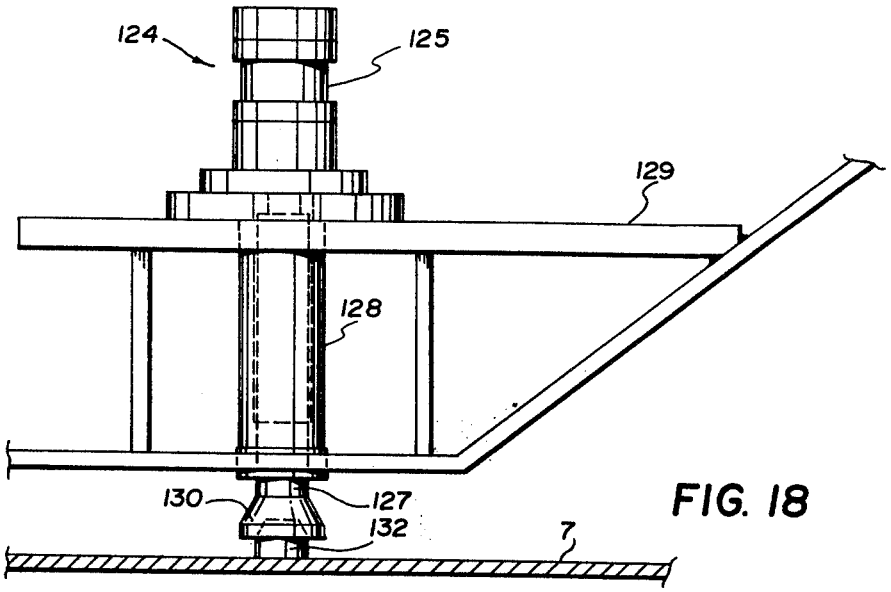

FIG. 18 is a side view of one end of the gantry base member showing the locking member of FIG. 17.

Figure 19:
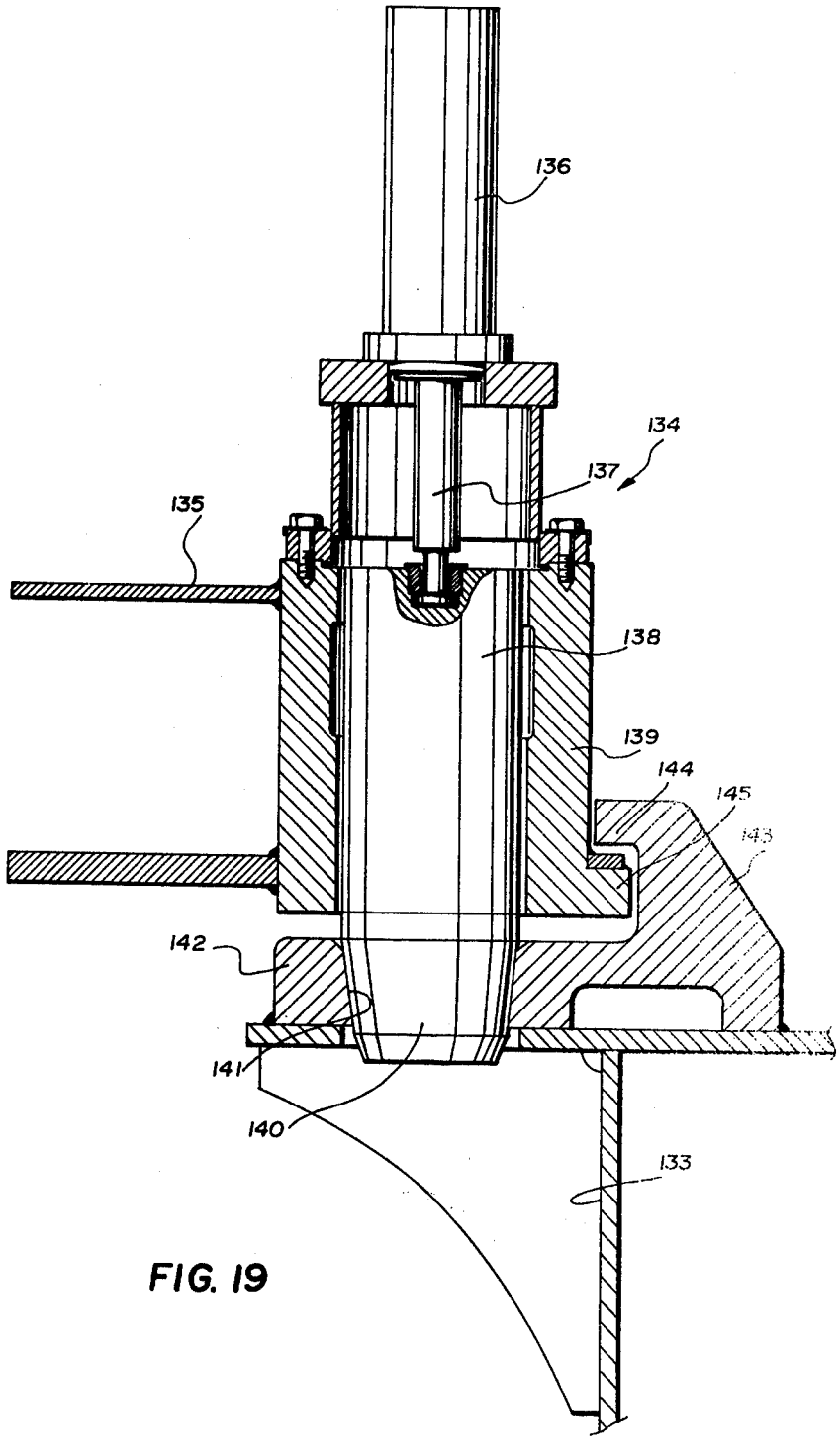

FIG. 19 is a vertical sectional detail of the means for securing the gantry crane in sea going position on the deck.

Figure 20:
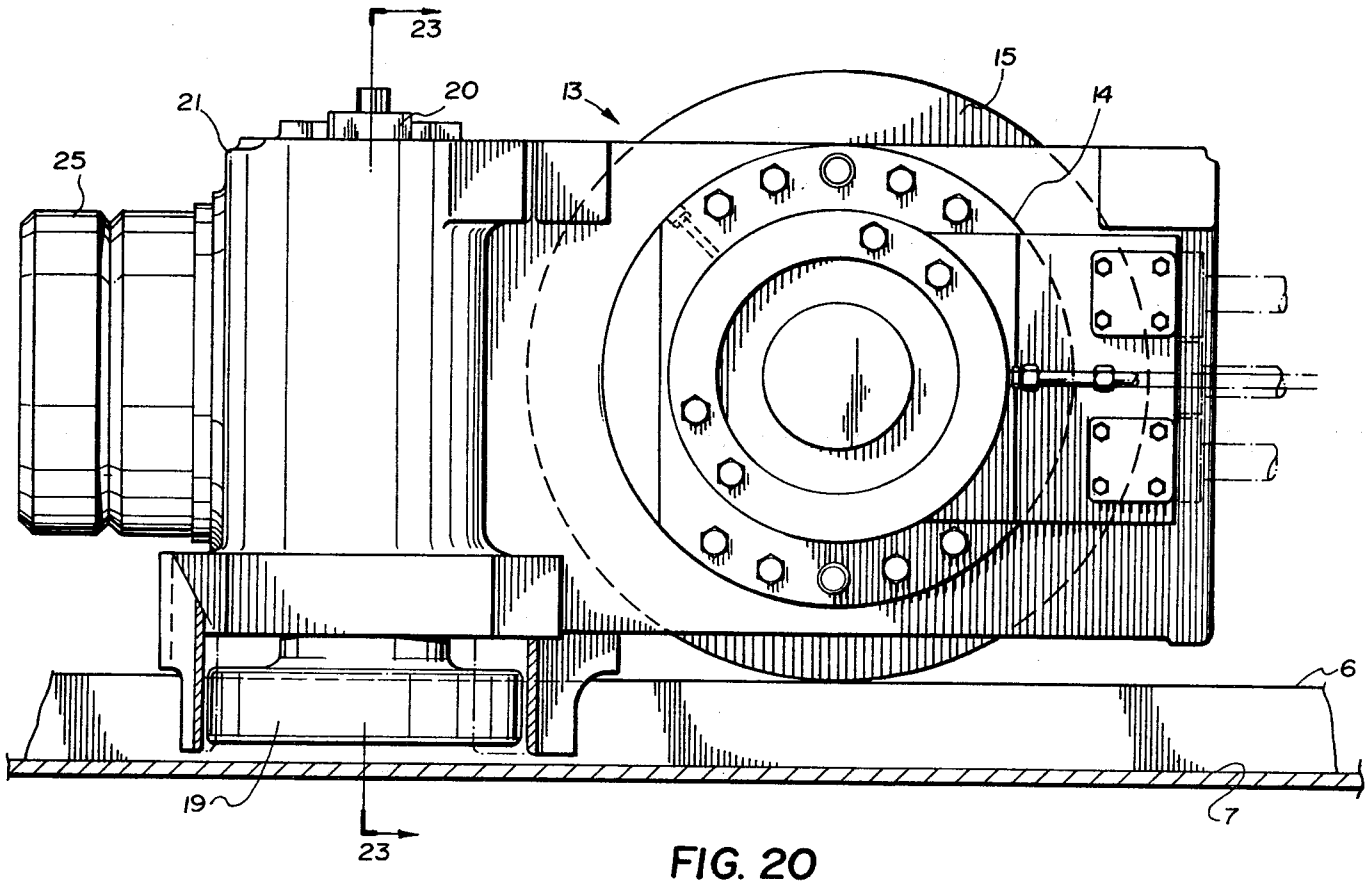

FIG. 20 is a side elevation of one of the wheel units supporting the gantry crane on the rails.

Figure 21:
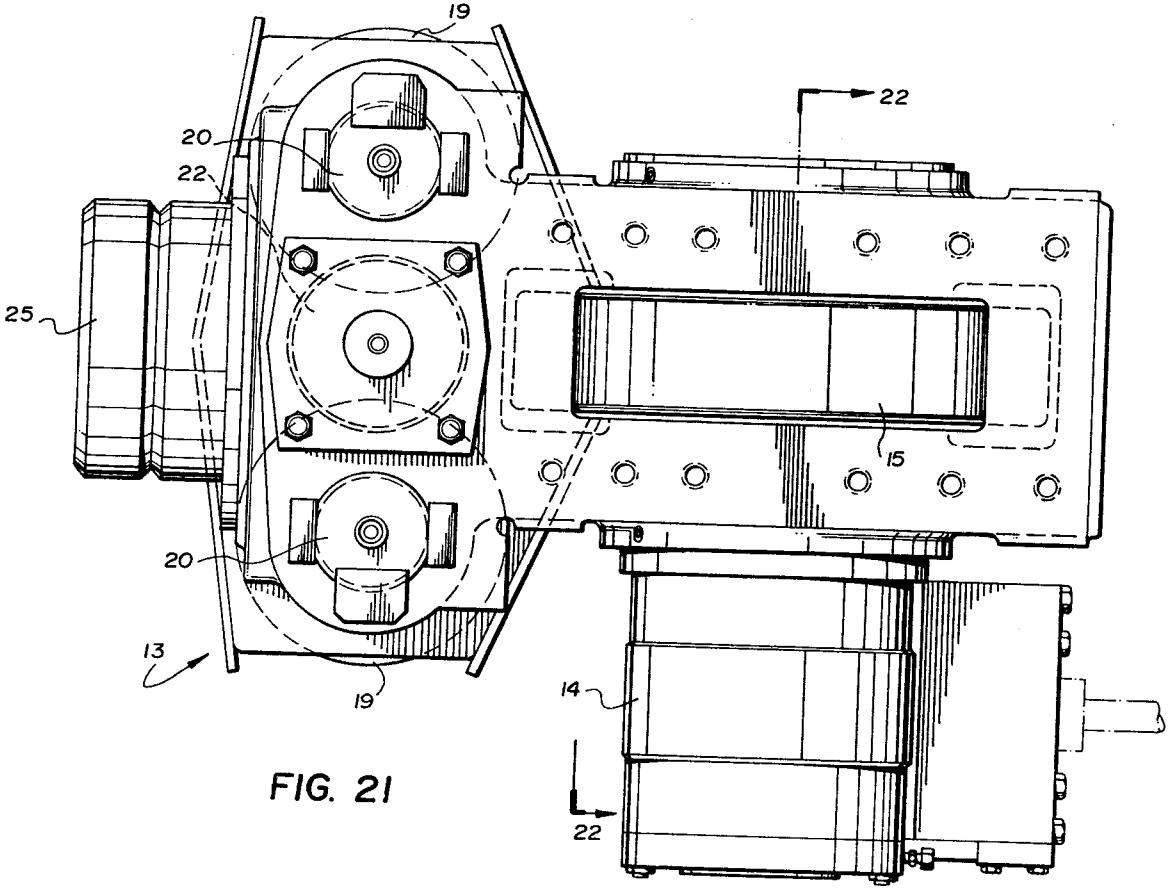

FIG. 21 is a top plan view of the wheel unit shown in FIG. 20.

Figure 22:
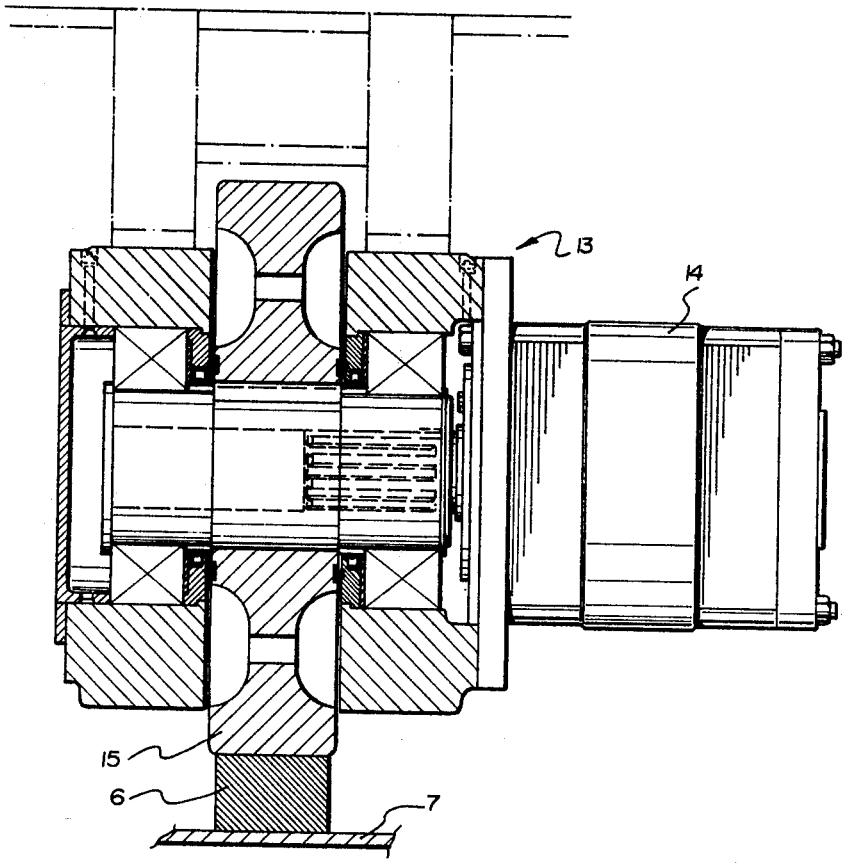

FIG. 22 is a partial vertical section taken on the line 22—22 of FIG. 21.

Figure 23:
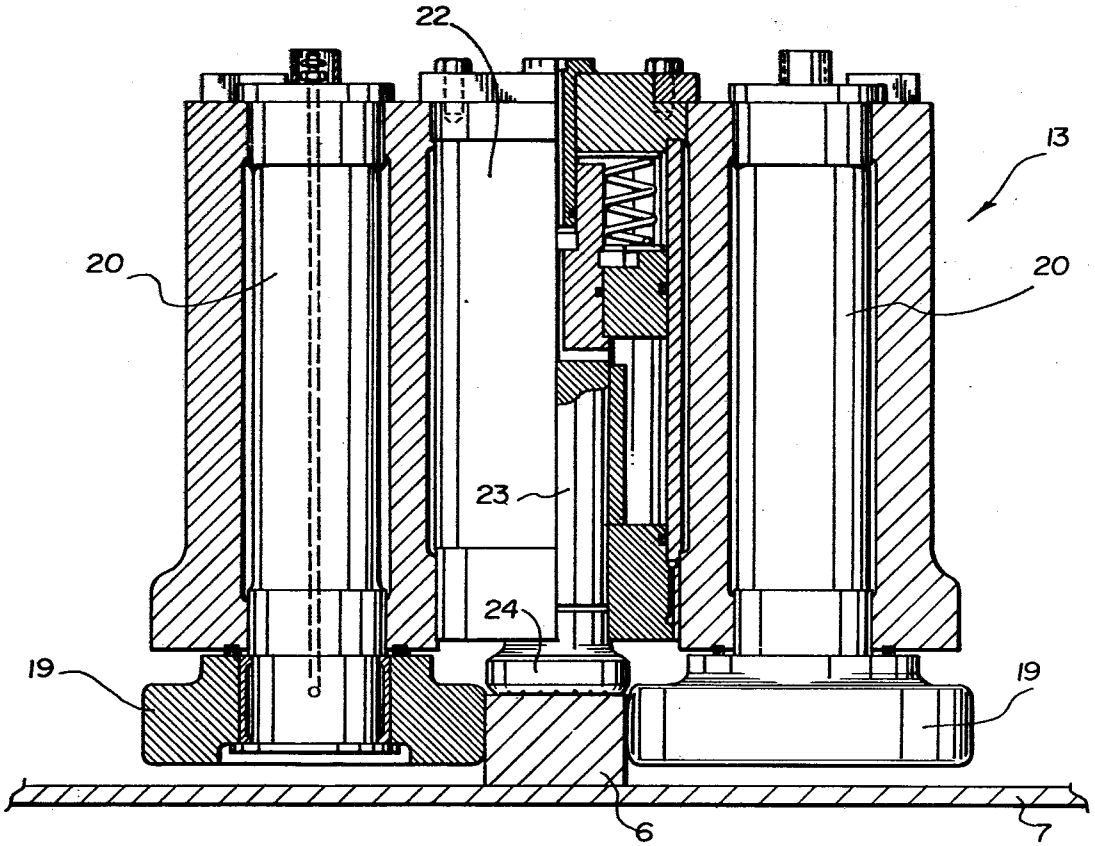

FIG. 23 is a vertical section taken on the line 23—23 of FIG. 20.

Figure 24:
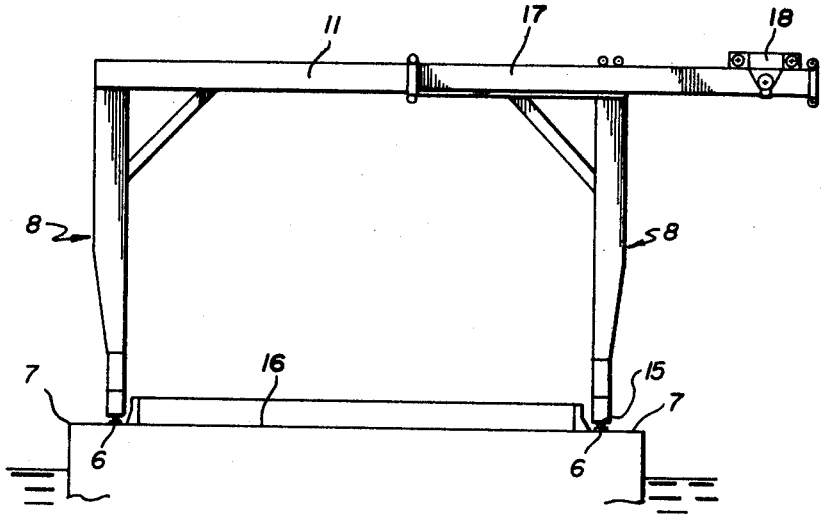

FIG. 24 is a schematic view of a shipboard gantry crane where the crane is mounted for running on rails laid on the deck of the ship.

Figure 25:
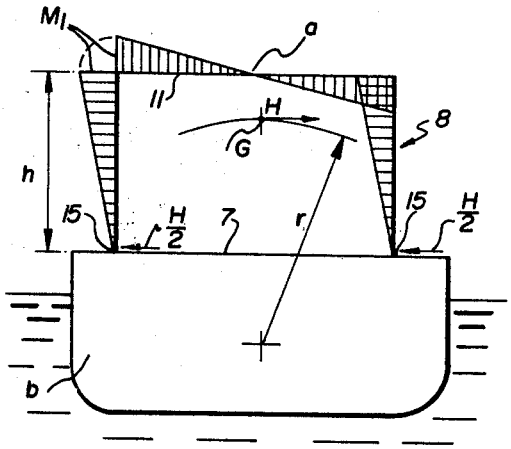

FIG. 25 is a bending moment diagram of the crane shown in FIG. 24.

Figure 26:
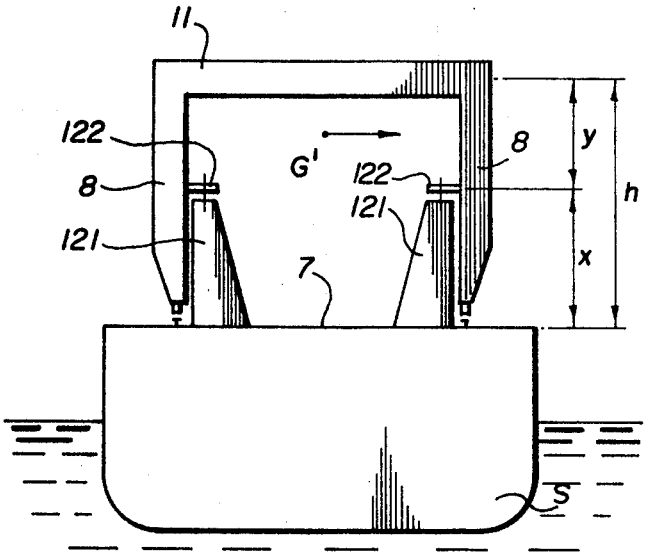

FIG. 26 is a schematic view of a shipboard gantry crane where the crane is secured to structures projecting upwards from the deck of the ship.

Figure 27:
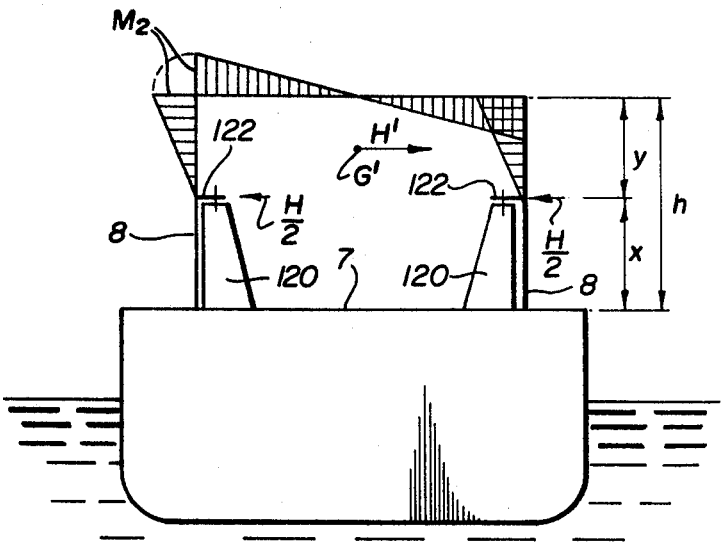

FIG. 27 is a bending moment diagram of the crane shown in FIG. 26.

Figure 28:
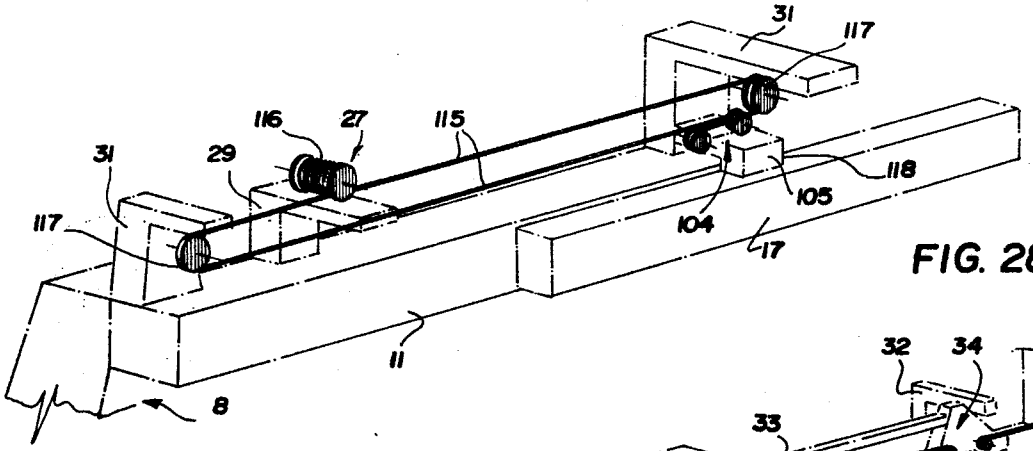

FIG. 28 is a schematic view showing the shuttle girder rope drive.

Figure 29:
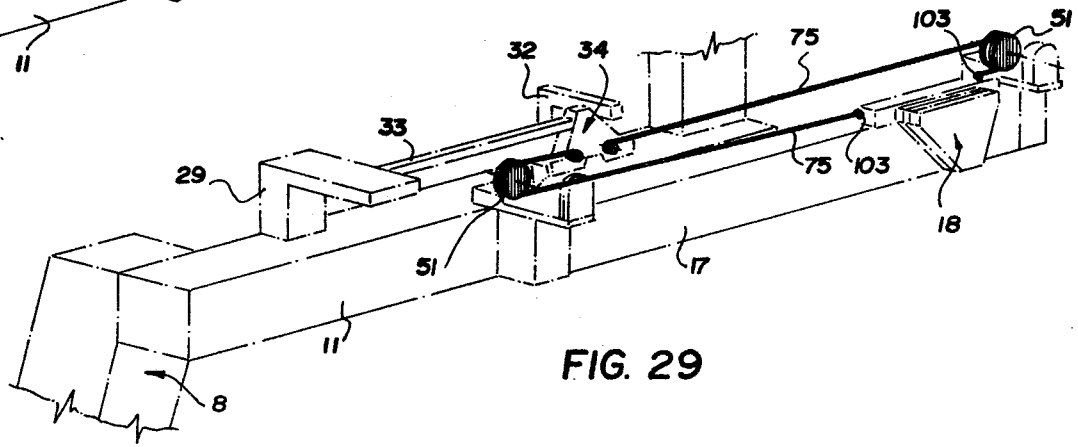

FIG. 29 is a schematic view showing the trolley rope drive.

Figure 30:
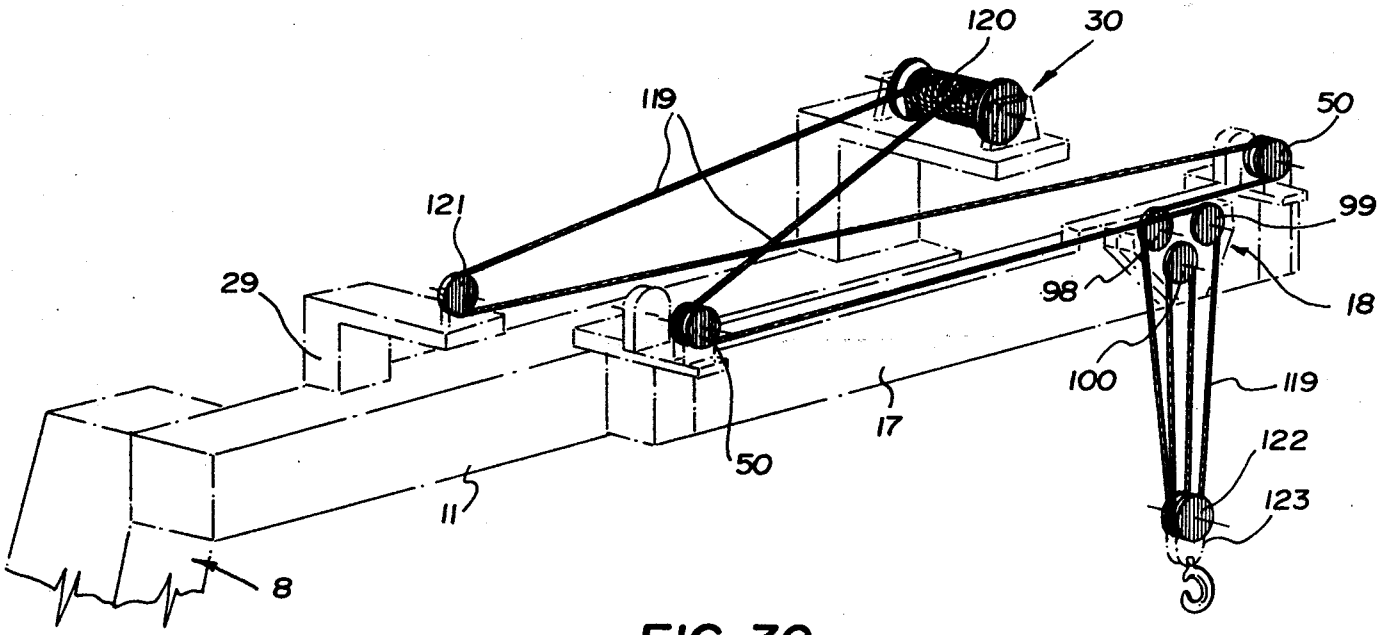

FIG. 30 is a schematic view showing the load hoisting rope drive.

Referring to the drawings and particularly to the form of the invention shown in FIGS. 1, 2, 3 and 4, each of the pair of travelling gantry cranes 5 are here shown mounted for movement longitudinally on rails 6 laid on the weather deck 7 of a ship but are equally adapted for shore installations such as for movement along rails laid on docks, etc.

Figure 1:
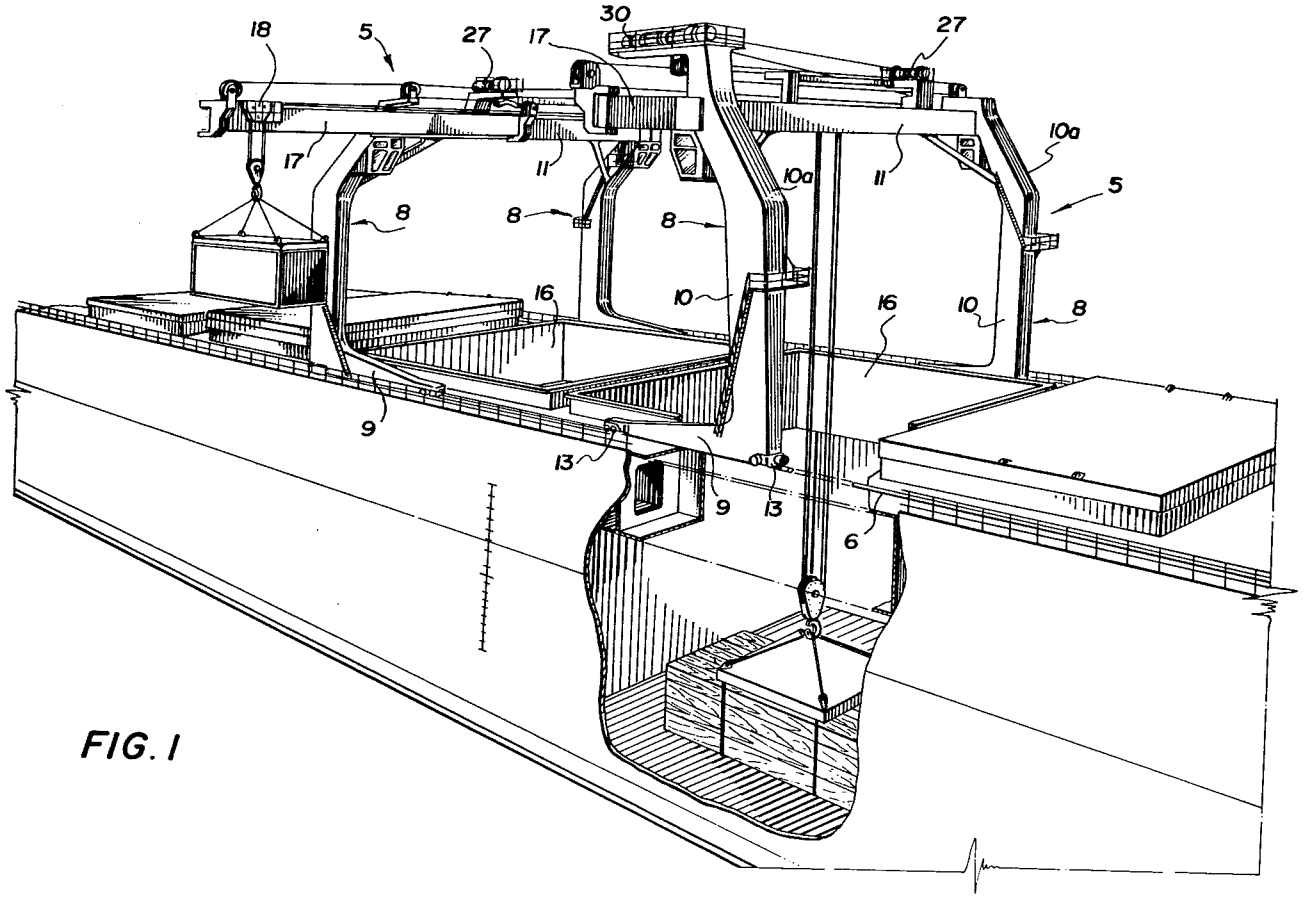
FIG. 1 is a partial perspective view of a portion of a ship showing two travelling gantry cranes according to the present invention, showing one shuttle girder inboard and one shuttle girder outboard of the ship.
Figures 2, 4:
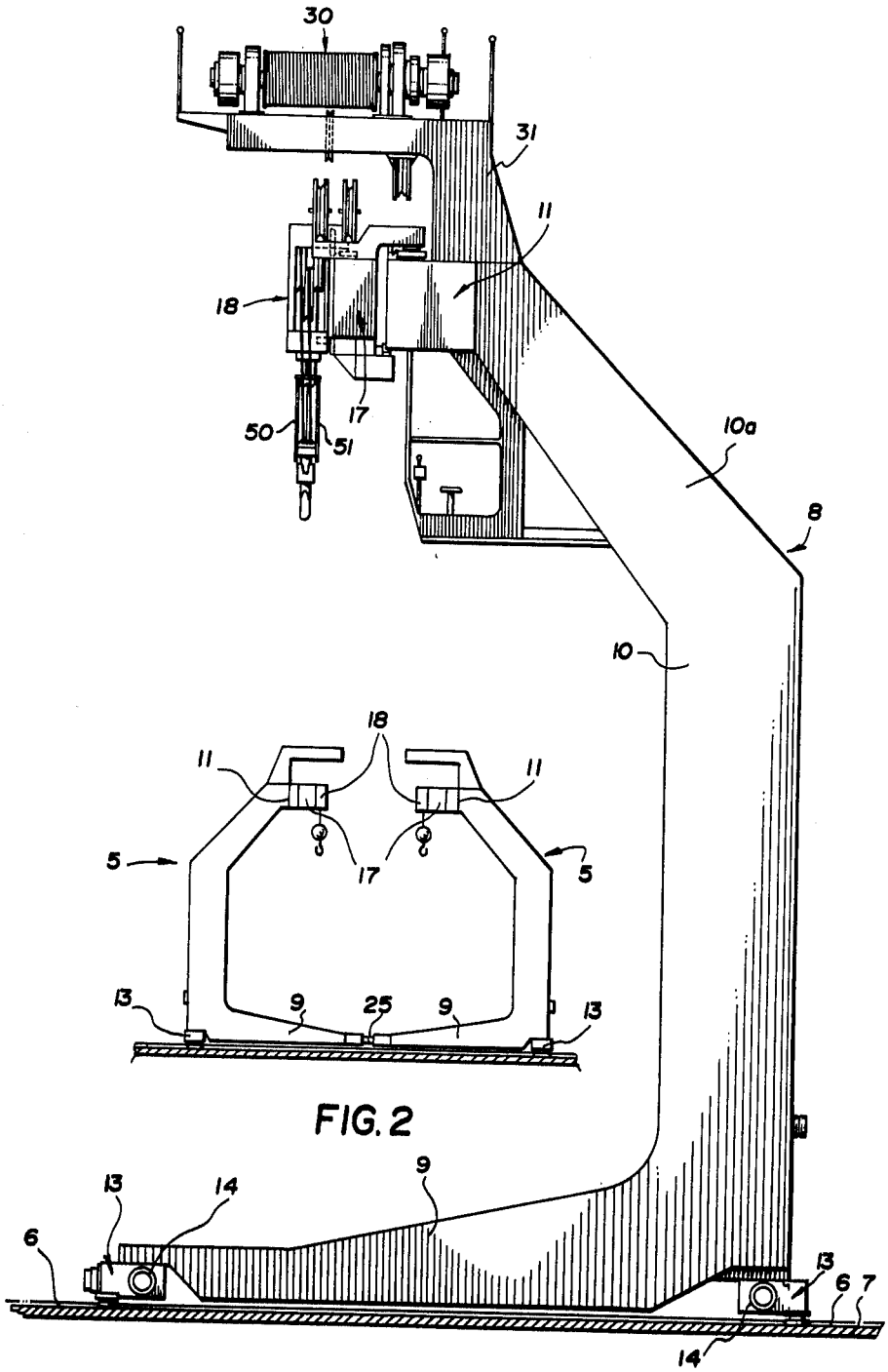
FIG. 2 is a side view in outline of a pair of gantry cranes in face-to-face arrangement for maximum load lifting capacity.
FIG. 4 is a side elevation of the gantry crane shown in FIG. 3.

The gantry cranes 5 are preferably used in pairs and for this purpose are mounted on the rails 6 on the deck 7 in face-to-face arrangement, as shown in FIGS. 1 and 2, for operating together for maximum load carrying capacity and speed of loading and unloading, but each crane 5 can be used individually for the transfer of normal loads.

Each gantry crane 5 includes a pair of legs 8 which are generally of C-shape, each of which has a forwardly projecting base member 9, a pair of vertically projecting columns 10 located at one end of the base members 9. The upper portion 10*a* of the columns 10 project upwardly and forwardly to form with the base member the general C-shape of the legs 8.

A bridge girder 11 is secured at its ends to the outer facing uppermost part of the portion 10*a* of the columns 10 and is located in a vertical plane intermediate of the length of the base member 9. Brace members 12 support the end portions of the bridge girder 11 on the legs 8.

A pair of wheel units 13 are mounted, one at each end of the base members 9. Each of the wheel units 13 include a hydraulic motor 14 or electric or other form of motive power, driving a wheel 15 for movement of the gantry cranes 5 on the rails 6 which are laid on the deck 7, one on the starboard side and one on the port side outwardly of the hatch openings 16.

The wheel units 13 are designed to provide resistance to sideways movement of the gantry crane, particularly when the shuttle girder 17 and the load hoisting trolley 18 are being moved outwardly of the ends of the bridge girder 11.

Each of the wheel units 13, in addition to having the main driving wheels 15 running on the top surface of the rails 6, are provided with a pair of wheels 19 mounted on the lower ends of the shafts 20 which are journalled in the end portion 21 of the wheel units 13. The wheels 19 rotate in a horizontal plane in running contact with the opposite side of the rails 6.

While hydraulic motors have been described and illustrated for driving the gantry wheels 15, it is to be understood that other forms of motive power could be used, such as electric motors.

Between the two shafts 20 in the wheel units 13 there is provided a brake mechanism including a brake cylinder 22 operating a rod 23 having a head 24 which makes braking contact with the top surface of the rails 6. Thus, there are four braking efforts between the crane and the rails on which the crane runs.

A buffer 25 is provided at one end of the base member 9 of the C-shaped legs 8 of the gantry crane. The buffer is used principally when two gantry cranes are used together in the manner shown in FIG. 2.

The bridge girder 11, mounted on the forward facing upper portion 10*a* of the columns 10, supports the shuttle girder 17 which is mounted for longitudinal movement along the forward facing side 26 of the bridge girder 11.

The shuttle girder 17 has an overall length short of the length of the bridge girder 11, measured between opposing inner facing surfaces of the legs 8.

The hoisting trolley 18 is mounted on the outer facing edge portion of the shuttle girder 17 for longitudinal movement relative to the shuttle girder, and the thwartwise movement of the hoisting trolley 18, together with the thwartwise movement of the shuttle girder 17, outwards of one or the other end of the bridge girder 11, provides for maximum outreach of the load carried by the hoisting trolley 18 beyond the outer ends of the bridge girder 11.

The shuttle girder 17 is movable thwartship relative to the bridge girder 11 by means of the winch 27 which is mounted on a platform 28 supported by the bracket 29 which, in turn, projects upwards from the top surface of the bridge girder 11, as shown in FIGS. 3 and 4, and a load hoisting winch 30 is mounted on a platform supported by a bracket 31 projecting upwards from the top of one of the gantry legs 8, as shown in FIGS. 3, 4 and 5.

Between the bracket 29 and a second bracket 32 projecting upwards from the top surface of the bridge girder 11, there is supported a guide rail 33. The brackets 29 and 32 are spaced apart equally on either side of the mid length of the bridge girder 11 and the guide rail 33 supports a rope-end fastening device 34 which is movable along the guide rail and is secured thereto at one or the other end of the guide rail by the locking means 35 which is more particularly described in connection with FIGS. 10 and 11 of the drawings.

Referring now to FIGS. 13 and 14, the shuttle girder 17 which is of box section has a pair of end brackets 36 secured on the top surface of the girder 17 and a pair of end brackets 37 secured to the bottom surface of the girder 17. The top end brackets 36 extend outwards from one side of the shuttle girder 17 to lie over the adjacent top surface of the bridge girder 11 and each bracket supports a pair of rollers 38 and 39. The rollers 38 are mounted for rotation in a vertical plane for rolling contact with the horizontal surface 40 of the rail 41 mounted on the top edge surface of the bridge girder 11, while the rollers 39 are mounted for rotation in a horizontal plane for rolling contact with the vertical surface 42 of the rail 41.

The bottom end brackets 37 extend outwardly from the same one side of the shuttle girder 17 as do the brackets 36 to lie under the adjacent bottom surface of the bridge girder 11, and each supports a pair of rollers 43 and 44. The rollers 43 are mounted for rotation in a vertical plane for rolling contact with the horizontal surface 45 of the rail 46 mounted on the bottom edge surface of the bridge girder 11, while the roller 44 is mounted for rotation in a horizontal plane for rolling contact with the vertical surface 47 of the rail 46.

The rollers 38, 39, 43 and 44, hold the shuttle girder 17 in spaced relation outwardly of the adjacent vertical surface 26 of the bridge girder 11 for traverse movement of the shuttle girder 17 parallel to the bridge girder 11.

Mounted on the upper surface of the top end brackets 36, at each end of the shuttle girder 17, are a pair of sheave brackets 48 and 49, the brackets 48 supporting a rope sheave 50 while the brackets 49 support a rope sheave 51.

Referring now to FIGS. 10, 11 and 12, the guide rail 33, supported between the brackets 29 and 32, supports in rolling contact the rope-end fastening device 34. The rope-end fastening device 34 includes side plates 52 supporting upper stub shafts 53 on which are mounted the flanged rollers 54, and lower shafts 55 on which are mounted the flanged rollers 56. The rollers 54 and 56 make rolling contact with the upper and lower edge surfaces of the guide rail 33.

The rope-end fastening device 34 is locked in position at one end or the other of the guide rail 33 by the pair of hydraulic locking devices 57, one of which is mounted on the guide rail 33 adjacent one end thereof and the other adjacent the opposite end of the guide rail. The upper stub shafts 53 and their rollers 54 provide between them a gap to permit the device 34 to move freely on either side of the locking devices 57, as will be seen in FIG. 11.

Each locking device 57 includes a sleeve 58 set vertically and centrally in the guide rail 33, and a hydraulic cylinder 59 is mounted on the top end of the sleeve 58. A piston 60 and a piston rod 61 reciprocate within the cylinder 59 and the lower end of the piston rod 61 engages with the locking rod 62 which, when lowered, engages with a bushing 63 set in the structural member 64 of the rope-end fastening device 34.

While the locking devices 57 are shown mounted on the guide rail 33 and a rod 62 engages with the rope-end fastening device 34, this arrangement could be reversed with the rod 62 engaging with apertures of each end of the guide rail 33. Alternatively, where the rope-end fastening device 34 does not have to be adjusted frequently on its guide rail 33, a simple lever lock may be employed.

The rope-end fastening device 34 is moved from a position at one end of the guide rail 33 to a position at the opposite end of the guide rail by activating the winch 27 and the traversing rope systems shown in FIGS. 28 and 29 when one or the other of the locking devices 57 is disengaged, depending in which direction the shuttle girder 17 and hoisting trolley 18 are to be moved.

Buffer support arms 65 extend outwardly from each end of the rope-end fastening device 34 below the level of the guide rail 33 and each arm supports a buffer block 66 which, when the device 34 is moved to one end or the other of the guide rail 33 and the shuttle girder 17 is moved to one outreach position or the other, engages within the recess 67 in the inward facing projections 68 of the sheave brackets 48–49. In addition, stops 69 are provided on the inner facing surfaces of the flanges 70 of the guide rail 33 and corresponding stops 71 are provided on the outer facing edges of the side plates 52. When the stops 71 engage with the stops 69, they ensure alignment of the locking rod 62 with the bushing 63 when the device 34 is positioned at one or the other end of the guide rail 33.

Mounted below the structural member 64 of the rope-end fastening device 34 and between the side plates 52 is a pair of drums 72 mounted on the shafts 73 supported on the side plates 74. One end of each of the trolley drive ropes 75 is secured each to one of the pairs of drums 72. Each of the drums 72 includes a worm gear 76 engaging with a worm 77. The worm 77 and worm gear 76 are adjusted to properly tension the trolley drive ropes 75 by rotating the worm shafts 78 in their support brackets 79 and securing the shafts 78 and consequently the drums 72 in their adjusted position by means of the stud screws 80.

Referring now to FIGS. 7, 8 and 9, the hoisting trolley 18 is of inverted L-shape, having an upper horizontal leg 81 and a vertical leg 82. The outwardly extending portion 83 of the horizontal leg 81 projects over the adjacent top surface of the shuttle girder 17 and supports a pair of vertically disposed shafts 84, on the lower end of which is mounted the rollers 85. Also supported in the portion 83 of the horizontal leg 81 is a pair of horizontally disposed stub shafts 86, on the other end of which is mounted a flanged wheel 87. The rollers 85 make running contact with the vertical surface 88 of the rail 89 located on the upper adjacent corner of the shuttle girder 17. The flanged wheels 87 make running contact with the horizontal surface 90 of the rail 89.

The lower end of the vertical leg 82 of the hoisting trolley 18 supports the vertical stub shaft 91 and the horizontal stub shaft 92. The roller 93 on the stub shaft 91 makes running contact with the vertical surface 94 of the rail 95 located on the adjacent lower corner of the shuttle girder 17, and a flanged roller 96 on the stub shaft 92 also makes running contact with the rail 95.

With this arrangement, the hoisting trolley 18 is maintained in spaced relation for movement along the outer facing surface 97 of the shuttle girder 17.

The vertically disposed leg 82 of the hoisting trolley 18 supports the hoisting rope sheaves 98, 99 and 100.

Buffer stops 101, one at each end of the hoisting trolley 18, make contact with the stops 102 on the brackets 36 on the ends of the shuttle girder 17.

The ends of the trolley drive ropes 75 remote from the rope-end fastening device 34 are secured to the trolley 18 at 103.

A rocker unit 104, shown in detail in FIGS. 15 and 16, is mounted centrally of the length of the shuttle girder 17 on the bracket 105 on the top surface of the shuttle girder. The rocker unit 104 includes a pair of side plates 106 supporting a pair of axle pins 107 on which the rollers 108 are journalled. The rocker unit 104 is supported on the inner facing surface 109 of the bracket 105, facing towards the bridge girder 11, by the pivot shaft 110 which is supported by the inner support 111 fixed to the bracket 105 and the outer support 112. The rollers 108 run on the top surface 40 of the rail 41 on the top edge surface of the bridge girder 11. The bracket 105 extends outwards over the upper surface of the bridge girder 11 to support a roller assembly, including a roller 113 mounted on the lower end of the shaft 114, and makes rolling contact with the vertical surface 42 of the rail 41 on the upper adjacent edge of the bridge girder 11 in the same manner as do the rollers 39 located at the ends of the shuttle girder. The rocker unit 104 and the roller 113 provide the required added support for the shuttle girder on the bridge girder when the end of the shuttle girder is extended beyond one end of the bridge girder, as shown in FIG. 5. The rocker unit 104 ensures continuous wheel contact by both wheels 108 in the "multi-axle" configuration between the shuttle girder 17 and the bridge girder 11.

When the shuttle girder 17 is in the mid position, shown in FIG. 3, the wheel contact is provided by wheels 38–108, 108–38 and, when the shuttle girder 17 is in the overhang position, shown in FIG. 5, wheel contact is provided by wheels 38–108, 108.

Referring now to FIG. 28 which is a schematic showing of the shuttle girder rope drive, the shuttle girder traversing winch 27 mounted above the bridge girder 11 has a drive rope 115 wound about the winch drum 116 of the winch 27 and the ends of the rope 115 extending from the drum 116 are laid about the sheaves 117 located on the brackets 31 at the top of the legs 8 of the gantry crane and the ends of these ropes are securely fastened to the bracket 105 supporting the rocker unit 104 on the shuttle girder 17 at 118.

In FIG. 29 which is a schematic showing of the drive for traversing of the hoisting trolley 18 on the shuttle girder 17, the pair of trolley drive ropes 75 are each secured at one end to the trolley 18 at 103 and about the sheaves 51 on the ends of the shuttle girder 17, and the other ends of these ropes are secured to the drums 72 of the rope-end fastening device 34. The trolley 18 is traversed on the shuttle girder 17 by movement of the device 34 to one end or the other on the guide rails 33. As the shuttle girder 17 is moved outwards from a mid position to either port or starboard relative to the bridge girder 11, the trolley 18 will move outwards on the shuttle girder 17. Therefore, the shuttle girder traversing winch 27 also effects movement of the trolley 18 on the shuttle girder 17.

In FIG. 30 which is a schematic showing of the load hoisting rope drive, the hoisting rope 119 has both ends anchored to the drum 120 of the hoisting winch 30. One end portion of the hoisting rope 119 is laid over the sheave 121 mounted on the bracket 29 on the bridge girder 11 and then over the sheave 50 on the opposite end of the shuttle girder 17. The other end portion of the rope 119 is laid over the sheave 50 on the end of the shuttle girder 17 adjacent to the sheave 121 and bracket 29. The mid portion of the rope 119 between the sheaves 50 is laid about the sheaves 98, 99 and 100 on the hoisting trolley 18 and about the sheave 122 on the crane hook block 123. During traversing movement of the hoisting trolley 18, the trolley sheaves 98, 99, 100 and 122 do not rotate thus greatly reducing the wear on both sheaves and rope 119 and also reducing maintenance on the system.

Referring now to FIGS. 17 and 18, in order to locate the gantry crane 5 in any designated position on the deck 7 of the ship when holds are being serviced, locking devices 124 are mounted on the sides of the base members 9 of the gantry crane legs 8. The locking devices 124 each consist of a hydraulic cylinder 125 having a piston rod 126 connected at its lower end with the top end of the locking bar 127, movable in the sleeve 128 which is secured in the bracket 129 projecting from the side of the base members 9 of the gantry. The lower end of the locking bars 127 has a head 130 having a tapered recess 131 which, when the locking bar 127 is lowered, engages with one of a series of pins 132 projecting upwards from the surface of the deck 7.

When the ship is at sea, the two gantry cranes must be securely anchored in positions on the deck so as not to materially alter the trim of the ship. The after gantry is preferably secured to the after deck superstructure, while the forward gantry is preferably secured midship.

The gantry crane as above described and mounted on the deck of a ship is subject to severe motions such as rolling, pitching, yawing, etc. when the vessel is at sea. Such action greatly influences the momentum of the gantry crane so that excessive horizontal forces tend to displace the gantry crane. In order to counteract these horizontal forces, each leg 8 of the gantry crane is provided with retaining means engageable with a structure of a suitable height above the level of the deck 7.

In FIG. 19 there is shown one form of means for securing the forward gantry. This includes a pair of deck structures in the form of pedestals 133, one on the port side and one on the starboard side of the ship and their location lengthwise of the ship is determined by the overall trim characteristics of the ship. These deck structures 133 are located inwards of the side of the ship to permit the gantry cranes to pass between them and the bulwarks of the ship. These deck structures 133 stand relatively high above the level of the weather deck 7 in order that the locking devices 134, mounted on the brackets 135, projecting from the inner facing surface of the gantry legs 8, will be located close to the center of gravity of the gantry cranes.

The locking devices 134 each includes a hydraulic cylinder 136, a piston operated rod 137 whose lower end is connected to the upper end of a locking rod 138 which reciprocates within the sleeve 139 secured to the bracket 135. The lower end 140 of the locking rod 138 is tapered for engaging in the tapered aperture 141 in the locking plate 142 which is secured to the top surface of the deck structure 133.

On the upper surface of the locking plate 142 there is provided a bracket 143 having a projecting lip 144 at its upper end which, when the gantry is in securing position on the deck 7, the lower end 140 of the locking rod 138 is engaged in the aperture 141 in the locking plate 142. The projecting lip 144 overlaps a projection 145 on the lower end of the sleeve 139 for added holding down protection of the gantry against rolling of the ship.

The after gantry crane, when not in use and particularly when the ship is at sea, is secured to the after superstructure of the ship. In order that the after gantry crane will not obstruct observation from the bridge, preferably the forward portion of the superstructure has a reduced width approximately that of the width of the hatch coamings, thus leaving the weather deck to port and starboard of the superstructure clear of obstruction on which the rails 6 can be extended rearwards. With this arrangement, the after gantry crane can be moved into the space on either side of the reduced width portion of the superstructure with the bridge girder and the movable girder bridging the superstructure. Locking devices similar to that shown in FIG. 19 can be utilized to lock the after gantry crane to the outward facing surfaces of the superstructure.

In order to illustrate the need for such retaining means for the gantry, as shown in FIG. 19, there is illustrated diagrammatically FIGS. 24, 25, 26 and 27 the forces acting on the gantry with and without the securing means described above.

In FIG. 24 there is shown in outline the gantry crane of the present invention with the shuttle girder 17 and the hoisting trolley 18 in the outboard position.

In FIG. 25, without the gantry securing means illustrated in FIG. 19, the center of gravity G of the gantry crane is at a considerable height above the deck 7 and the horizontal force H acts at the center of gravity G due to the rolling of the vessel. The horizontal force H is countered by the contact of the wheels 15 and 19 with the rails 6. Alternatively, the force H could be countered by other anchoring means such as wire ropes, pins, screws or the like securing the lower portion of the legs 8 to the deck 7. In such an arrangement, the gantry crane is anchored or retained securely in position so that excessive bending moments occur in the legs 8 and the bridge girder 11 due to the horizontal force H so that the legs 8 and the bridge girder 11 must be increased in strength accordingly. As a result, the weight of the crane is increased resulting in the inevitable increase in both the weight and dimensions of the vessel.

Referring to FIG. 25, the mechanics of the horizontal force H is described in detail. Due to the pendulum-like motion with a radius $r$ of the vessel, due to rolling, the horizontal force H acts on the center of gravity G on one side of each leg 8 and the lower end thereof encounters the force equal to one-half of the horizontal force H, that is a force of H/2. As a result, due to the reaction forces H/2 in the legs 8 and the bridge girder 11, the bending moment at the joint between the top of the legs 8 and the bridge girder 11 is:

$$M_1 = H/2 \times h$$

where $h$ = the height of the legs

The gantry crane, according to the present invention, secured to the deck of the vessel by the means illustrated in FIGS. 19, 26 and 27 has for its object to decrease the above bending moment produced by the horizontal force H by as much as possible, thereby reducing the weight of the gantry crane and hence the weight of the vessel.

Referring to FIGS. 26 and 27, the deck structure 133 has a height of $x$ above the deck 7; the height of the legs 8 above the deck 7 is $h$, and the distance between the securing of the gantry at the top of the deck structure 133 and the joint of the legs 8 with the bridge girder 11 is $y$; and G′ is the center of gravity of the gantry.

The horizontal force H′ which acts at the center of gravity G′ due to the rolling of the vessel is supported equally by the retaining means 132–133. That is, each retaining means 132–133 receives a force of H/2. Therefore, the maximum bending moment which occurs in the legs 8 or the bridge girder 11 due to the reaction force H/2 from the retaining means 132–133 is:

$$M_2 = H/2 \times h$$

However, $h = x + y$ and $h > y$. Therefore, it is apparent that $M_2 > M_1$. That is, the maximum moment which occurs in the legs 8 or bridge girder 11 provided with the retaining means 132–133 illustrated in FIGS. 26 and 27 is substantially smaller than the maximum moment which occurs in conventional gantry cranes of the type shown in FIGS. 24 and 25.

Because of the arrangement shown in FIGS. 19, 26 and 27, the gantry crane of the present invention can be decreased in weight and strength so that motors of smaller capacity may be used for operating the crane.

Where the gantry crane must support exceptionally heavy loads, a modified form of the legs and bridge girder is shown in FIG. 4*a*. In this form the upper portion 146 of the legs 8*a* are in the form of an inverted U-shape, the inner leg 147 of which supports the inner bridge girder 11*a* and the outer leg 148 supports the outer bridge girder 11*b*. The opposing upper corners of the bridge girders 11*a* and 11*b* are each provided with a pair of rails 149 and 150.

A load hoisting trolley 18*a* is provided with flanged rollers 151 running on top of the rails 149 and with flanged rollers 152 running on the under surface of the rails 150.

In the operation of this invention, the operation of one only of the gantry cranes will first be discussed. The gantry crane 5 is moved along the deck 7 on the rails 6 to a desired location relative to one of the holds of the ship by activating the hydraulic motors 14 of the wheel units 13, and is locked in this position by a) hydraulically operated brakes incorporated in the wheel units 13 locking the gantry to the rails 6, and b) locking of the gantry to the deck of the ship by the locking devices 124 engaging with the pins 132 projecting upwards from the deck 7 of the ship.

Depending on which side of the ship is to be worked, the rope-end fastening device 34 is moved to one end or the other of the guide rail 33. This is accomplished by releasing one or the other of the locking devices 57 and activating the traversing winch 27 to effect traverse movement of the shuttle girder 17 by means of the rope drive systems 115 and 75.

When it is desired to move the rope-end fastening device 34, the locking device 57, holding the device 34 in one position, is disengaged and the traversing system is activated in the normal manner until the shuttle girder 17 and the device 34 buffers 66–67 make contact, whereafter the shuttle girder pushes the device 34 to the opposite end of the guide rail 33. The opposite locking device 57 is then engaged and the crane is ready for operation over the opposite side of the ship.

The rope-end fastening device 34 also acts as a stop to limit the outreach of the shuttle girder 17 and consequently, the outreach of the load hoisting trolley 18 to one side or the other of the ship. The location of the rope-end fastening device 34 on its guide rail 33 and the length of the shuttle girder are such that when the shuttle girder 17 is moved inboard, the load hoisting trolley 18 can be located close to one end of the bridge girder 11 and in line with one side wall of the hatch coaming below, and when the shuttle girder 17 is moved outboard, the load hoisting trolley 18 can be moved well outboard of the ship.

The movement of the shuttle girder 17 and the load hoisting trolley 18 from the at-rest position midway of the bridge girder to the extreme outboard position at one side or the other of the ship is controlled by the traversing winch 27 and the rope drive between the winch 27 and the rocker unit 104 located midway of the length of the shuttle girder, shown schematically in FIG. 28. The traversing of the load hoisting trolley 18 is carried out in unison with the traversing of the shuttle girder and is controlled by the same traversing winch 27 through the rope drive between the rope-end fastening device 34 and the load hoisting trolley 18, shown schematically in FIG. 29, where the load hoisting trolley is moved relative to the shuttle girder 17 as the shuttle girder is moved relative to the bridge girder 11, the extreme outward movement of the shuttle girder 17 and the load hoisting trolley 18 being further controlled by the setting of the rope-end fastening device 34 at one end or the other of the guide rail 33.

The control of both the traversing of the shuttle girder 17, FIG. 28, and the traversing of the load hoisting trolley 18, FIG. 29, by the single traversing winch 27 not only keeps the operating equipment and controls to a minimum, but enables the transfer of loads, both inboard and outboard, to be greatly speeded up.

The operation of hoisting or lowering of a load is controlled by a separate hoisting winch 30, shown schematically in FIG. 30. This operation can be carried out simultaneously with the traversing of the shuttle girder 17 and the load hoisting trolley 18 as all movements of the shuttle girder and the hoisting trolley are maintained in parallel relation to each other and to the supporting bridge girder.

In an open type ship where there are no obstructions on the weather deck, the gantry crane can be moved freely along the deck simultaneously with the operation of traversing the shuttle girder and the load hoisting trolley so that loads can be rapidly transferred from or to any one of the holds of the ship and to or from any position at dockside.

Any and all of the above described operations can be carried out by a single gantry crane or by two gantry cranes arranged face-to-face with each other, as shown in FIG. 2, and the controls for both cranes can be coordinated to be operated from one of the cranes.

While rope drives are shown schemtically in FIGS. 28 and 29, it is to be understood that these drives could be replaced by mechanical drives such as rack and pinion or screw drives which can be satisfactorily employed where the bridge girder, the shuttle girder and the load hoisting trolley are all confined to parallel face-to-face alignment and movement relative to each other.

What I claim is:

1. A gantry crane for travelling along rails, the said crane having a pair of legs, the base portion of the said legs being horizontally disposed, a rail engaging drive wheel unit mounted on the end portions of the horizontally disposed base portion of the said legs, a bridge girder secured at its ends to the uppermost portion of the said pair of legs, a shuttle girder mounted for travel along one vertical outwardly facing surface of the said bridge girder for outreaching the ends of the bridge girder, a load hoisting trolley mounted for travel along a vertical outwardly facing surface of the said shuttle girder remote from the said bridge girder, the said load hoisting trolley being located in a vertical plane intermediate the length of the base portion of the legs of the gantry crane, means to move the said shuttle girder and the said load hoisting trolley relative to each other and to the said bridge girder, and means to operate the said load hoisting trolley to raise and lower a load at any position of the load hoisting trolley with respect to the said shuttle girder and the said bridge girder, and means to locate and secure the gantry crane in a designated position on the rails on which the crane travels, said means to move the said shuttle girder and the said hoisting trolley relative to each other and to the said bridge girder including a winch mounted on the said bridge girder, a first rope drive between the said winch and the midpoint of the said shuttle girder and inermediately reaved about a pair of pulleys, one located at each end of the bridge girder, a second rope drive between the shuttle girder and the load hoisting trolley, and means to adjust the said second rope drive to permit maximum extension of the shuttle girder and the load hoisting trolley outwards of either of the ends of said bridge girder.

2. A gantry crane as set forth in claim 1 in which the means to adjust the rope drive between the shuttle girder and the load hoisting trolley includes a rope-end fastening device to which the opposite ends of the above mentioned rope drive are secured, a guide rail mounted above the mid portion of the said bridge girder, the said rope-end fastening device being movably mounted on the said guide rail, and means to secure the said rope-end fastening device at one or the other end of the said guide rail.

3. A gantry crane as set forth in claim 2 in which the means to secure the rope-end fastening device on the said guide rail includes a pair of cylinder and piston locking devices, one mounted adjacent each end of the guide rail, and a locking rod operably connected to each of the said cylinder and piston devices, the said locking rods when moved into locking position engaging with the said rope-end fastening device to hold the said device at one or the other end of the said guide rail.

4. A gantry crane as set forth in claim 3 in which the said guide rail is of square section and the said rope-end fastening device has a pair of side walls, a pair of opposing upper stub shafts mounted in the said side walls and projecting inwardly over the said guide rail, a lower shaft mounted between the said side walls and located under the said guide rail, a series of rollers on the said shafts, the said rollers making running contact with the corners of the said guide rail, the gap between the opposing ends of the upper stub shafts permitting the rope-end fastening device to be moved into locking alignment with one or the other of the said cylinder and piston devices positioned adjacent the ends of the said guide rail.

5. A gantry crane as set forth in claim 3 in which the said rope-end fastening device is provided with a stop at each end thereof and the said guide rail is provided with stops at each end, the said stops on the said guide rail limiting the travel of the rope-end fastening device and into alignment with one or the other of the said cylinder and piston device to permit the locking rod of the cylinder and piston devices to make locking engagement with the rope-end fastening device.

6. A gantry crane as set forth in claim 2 in which the rope drive between the shuttle girder and the load hoisting trolley includes a pair of ropes each of which has one end fastened to opposite ends of the said trolley and the opposite ends of the said pair of ropes are each secured to one of a pair of drums on the said rope-end fastening device, and a worm and worm gear for each of the said drums, the said worm and worm gears being operable to rotate the said drums and adjust the tension in the said ropes secured to the drums, and securing means for each of said worm and worm gears to hold the said drums in the rope tension adjusted position.

7. A gantry crane as set forth in claim 1 in which the connection of the said rope drive between the said winch and the mid point of the said shuttle girder includes a bracket mounted on the top surface of the shuttle girder and projecting outwardly therefrom and over the said bridge girder, a pulley mounted on each end of the said bracket, and the said rope drive between the said winch and the mid point of the said shuttle girder having its end portions each connected to the one of the said pulleys opposite from the pulley on the bridge girder over which the end portions of the rope drive are reaved.

8. A gantry crane as set forth in claim 7 in which a rocker unit is pivotally mounted on the said bracket, the said rocker unit including a pair of rollers located on either side of the pivotal mounting of the rocker unit for running engagement on a horizontal surface on a rail on the adjacent upper edge of the bridge girder, and a roller assembly mounted on the said bracket, the said roller assembly including a vertically disposed shaft and a roller mounted on the lower end of the said shaft for running engagement with a vertical surface of the said rail on the upper edge of the bridge girder.

9. A gantry crane as set forth in claim 8 in which a ratchet device connects the said pulleys, to which the end portions of the rope drive are connected, and the said pivotal rocker unit to brake the said rocker unit on the rail on the bridge girder when the mid point of the said shuttle girder comes into line with one or the other ends of the bridge girder.

10. A gantry crane as set forth in claim 1 in which the means locating the gantry crane in a designated position includes a series of tapered projections on the surface on which the rails supporting the crane are laid, and cylinder and piston devices located on the lower portion of the legs of the crane, the said devices each including a rod having a tapered recess at its lower end for engaging with the said tapered projections.

11. A gantry crane as set forth in claim 1 in which the drive wheel units each include a wheel for running on the top surface of the rails on which the gantry crane is supported, a motor driving each of the said drive wheels, and a pair of horizontally spaced apart wheels rotatable about vertical axes and in running contact with opposite vertical side surfaces of the said rails.

12. A gantry crane as set forth in claim 1 in which the said drive wheel units each include a brake cylinder, a brake shaft reciprocable in the brake cylinder, a braking head on said brake shaft, the said braking head adapted to make braking contact with the top surface of the rails on which the gantry crane is supported.

13. A gantry crane for travelling along rails, the said crane having a pair of legs, the base portion of the said legs being horizontally disposed, a rail engaging drive wheel unit mounted on the end portions of the horizontally disposed base portion of the said legs, a bridge girder secured at its ends to the uppermost portion of the said pair of legs, a shuttle girder mounted for travel along one vertical outwardly facing surface of the said bridge girder for outreaching the ends of the bridge girder, a load hoisting trolley mounted for travel along a vertical outwardly facing surface of the said shuttle girder remote from the said bridge girder, the said load hoisting trolley being located in a vertical plane intermediate the length of the base portion of the legs of the gantry crane, means to move the said shuttle girder and the said load hoisting trolley relative to each other and to the said bridge girder, and means to operate the said load hoisting trolley to raise and lower a load at any position of the load hoisting trolley with respect to the said shuttle girder and the said bridge girder, and means to locate and secure the gantry crane in a designated position on the rails on which the crane travels, said shuttle girder being provided with a buffer stop located midway of the length of the shuttle girder, and the said bridge girder being provided with a first pair of stops, one located at each end of the bridge girder, and with a second pair of stops located in spaced apart relationship on either side of the midpoint of the length of the bridge girder, the said second pair of stops being individually retractable and together adapted to engage with the said buffer stop on the shuttle girder to hold same in midposition relative to the length of the bridge girder, and when one or the other of the second pair of stops on the bridge girder is retracted to permit the said shuttle girder to move outwardly in one direction or the other relative to the bridge girder to the limit provided by engagement of the said buffer stop on the shuttle girder with one or the other of the said first pair of stops at the ends of the bridge girder.

14. A gantry crane for travelling along rails, the said crane having a pair of legs, the base portion of the said legs being horizontally disposed, a rail engaging drive wheel unit mounted on the end portions of the horizontally disposed, base portion of the said legs, a bridge girder secured at its ends to the uppermost portion of the said pair of legs, a shuttle girder mounted for travel along one vertical outwardly facing surface of the said bridge girder for outreaching the ends of the bridge girder, a load hoisting trolley mounted for travel along a vertical outwardly facing surface of the said shuttle girder remote from the said bridge girder, the said load hoisting trolley being located in a vertical plane intermediate the length of the base portion of the legs of the gantry crane, means to move the said shuttle girder and the said load hoisting trolley relative to each other and to the said bridge girder, and means to operate the said load hoisting trolley to raise and lower a load at any position of the load hoisting trolley with respect to the said shuttle girder and the said bridge girder, and means to locate and secure the gantry crane in a designated position on the rails on which the crane travels, said load hoisting trolley including a series of hoisting rope pulleys, and the means to operate the said load hoisting trolley for raising and lowering a load including a hoisting winch mounted above one end of said bridge girder, a load hoisting rope reaved about the pulleys in the load hoisting trolley and about a load carrying hook block below the trolley, one end of the said rope being reaved about a pulley at one end of the said shuttle girder and the other end of the rope being reaved about a pulley at the opposite end of the shuttle girder and about a pulley mounted on the end of the said bridge girder opposite from the said hoisting winch, both ends of said load hoisting rope being secured to the said hoisting winch for simultaneous inwinding and outwinding of the rope.

15. A gantry crane for travelling along rails on the deck of a ship, said crane having a pair of legs, the base portion of the said legs being horizontally disposed, a rail engaging drive wheel unit mounted on the end portions of the horizontally disposed base portion of the said legs, a bridge girder secured at its ends to the uppermost portion of the said pair of legs, a shuttle girder mounted for travel along one vertically outwardly facing surface of the said bridge girder for outreaching the ends of the bridge girder, a load hoisting trolley mounted for travel along a vertical outwardly facing surface of said shuttle girder remote from said bridge girder, said load hoisting trolley being located in a vertical plane intermediate the length of the base portion of the legs of the gantry crane, means to move said shuttle girder and said load hoisting trolley relative to each other and to said bridge girder, and means to operate said load hoisting trolley to raise and lower a load at any position of the load hoisting trolley with respect to the said shuttle girder and the said bridge girder, and means to locate and secure the gantry crane in a designated position on the rails on the deck of the ship on which the crane travels, said means to secure the gantry crane in a designated position including a pair of pedestals located immediately inwards on the deck surface on which the rails supporting the crane is laid, and a locking device on the inward facing surface of said legs of the crane engageable with securing means located on the top surface of said pedestals.

16. A gantry crane as set forth in claim 15 in which the said locking devices on the inward facing surface of the legs are cylinder and piston devices operating a locking rod engageable with an aperture in a locking plate on the top of the said pedestals.

17. A gantry crane as set forth in claim 16 in which the said locking plate includes a bracket having a projecting lip engaging with a projection on the said locking device.

18. A gantry crane for travelling along rails, the said crane having a pair of legs, the base portion of the said legs being horizontally disposed, a rail engaging drive wheel unit mounted on the end portions of the horizontally disposed base portion of the said legs, a bridge girder secured at its ends to the uppermost portion of the said pair of legs, a shuttle girder mounted for travel along one vertical outwardly facing surface of the said bridge girder for outreaching the ends of the bridge girder, a load hoisting trolley mounted for travel along a vertical outwardly facing surface of the said shuttle girder remote from the said bridge girder, the said load hoisting trolley being located in a vertical plane intermediate the length of the base portion of the legs of the gantry crane, means to move the said shuttle girder and the said load hoisting trolley relative to each other and to the said bridge girder, and means to operate the said load hoisting trolley to raise and lower a load at any position of the load hoisting trolley with respect to the said shuttle girder and the said bridge girder, and means to locate and secure the gantry crane in a designated position on the rails on which the crane travels, said gantry crane being mounted on a vessel, and the means to secure the gantry crane including a locking device on the port and starboard outer facing surfaces of the after superstructure of the vessel where at least the forward portion of the superstructure has a width approximately that of the width of the hatch coamings, and the rails on which the gantry crane runs extending on either side of the said forward portion of the superstructure.

* * * * *